US007311335B2

(12) United States Patent
Muhs et al.

(10) Patent No.: US 7,311,335 B2
(45) Date of Patent: Dec. 25, 2007

(54) TRAILER AND FUEL TANK ASSEMBLY

(75) Inventors: David Muhs, Minnetonka, MN (US); Gianfranco Parma, Villa Verucchio (IT)

(73) Assignee: Water Management Systems, Minnetonka, MN (US)

( * ) Notice: Subject to any disclaimer, the term of this patent is extended or adjusted under 35 U.S.C. 154(b) by 195 days.

(21) Appl. No.: 10/140,231

(22) Filed: May 7, 2002

(65) Prior Publication Data

US 2002/0125680 A1 Sep. 12, 2002

Related U.S. Application Data

(62) Division of application No. 09/532,338, filed on Mar. 21, 2000, now Pat. No. 6,405,748.

(60) Provisional application No. 60/125,559, filed on Mar. 22, 1999.

(51) Int. Cl.
*B60R 9/00* (2006.01)

(52) U.S. Cl. ..... 280/837; 224/321

(58) Field of Classification Search ..... 280/763.1, 280/764.1, 765.1, 770, 479.2, 490.1, 491.1, 280/491.2, 476.1, 854, 149.2, 456.1, 837, 280/839; 410/77, 120, 34, 155; 296/198, 296/32, 36; 403/331, 258, 259
See application file for complete search history.

(56) References Cited

U.S. PATENT DOCUMENTS 640,345 A 1/1900 Wilberforce
1,555,023 A 9/1925 Prokofieff
1,735,754 A 11/1929 Hargis
1,763,595 A 6/1930 Paatsch
1,840,257 A 1/1932 Saxe et al.

(Continued)

FOREIGN PATENT DOCUMENTS

DE 573209 3/1933

(Continued)

OTHER PUBLICATIONS

Hidrostal, Sectional Drawings Q-Hydralic, 1 page, dated Sep. 19, 1994.

(Continued)

*Primary Examiner*—Kevin Hurley
(74) *Attorney, Agent, or Firm*—Brian N. Tufte

(57) ABSTRACT

A trailer and fuel tank assembly are disclosed. The fuel tank preferably forms the body of the trailer. The fuel tank may include a recess in the top surface for receiving the motor and/or pump, which may lower the pump closer to the ground to increase the suction performance of the pump. The bottom surface of the fuel tank may be bowed upward. This may cause any contaminants in the fuel tank to collect along the edges of the tank. Drain ports, positioned near the edges of the tank, can then be used to drain the contaminants from the tank. To easily attach accessories to the trailer, one or more track bars may be mounted to the trailer body. The track bars preferably include an elongate channel and an elongate slot. By placing an insert inside of the channel and bolting the accessory to the insert through the longitudinally extending slot, the accessories can be easily attached to the trailer.

19 Claims, 27 Drawing Sheets

U.S. PATENT DOCUMENTS

| | | | | | |
|---|---|---|---|---|---|
| 1,891,267 | A | | 12/1932 | Milkowski | |
| 2,306,988 | A | | 12/1942 | Adams | |
| 2,788,745 | A | | 4/1957 | Jennings | |
| 3,035,781 | A | | 5/1962 | Wallen | |
| 3,272,137 | A | | 9/1966 | Maitlen et al. | |
| 3,315,879 | A | | 4/1967 | Jennings | |
| 3,394,772 | A | | 7/1968 | Abold | |
| 3,518,028 | A | | 6/1970 | Minick | |
| 3,522,997 | A | | 8/1970 | Rylewski | |
| 3,543,368 | A | | 12/1970 | Marlow | |
| 3,610,780 | A | | 10/1971 | Smith | |
| 3,644,056 | A | | 2/1972 | Wiselius | |
| 3,712,764 | A | | 1/1973 | Shearwood | |
| 3,771,900 | A | | 11/1973 | Baehr | |
| 3,867,070 | A | | 2/1975 | Sloan | |
| 4,019,680 | A | | 4/1977 | Norris | |
| 4,057,368 | A | | 11/1977 | Balling | |
| 4,067,663 | A | | 1/1978 | Brooks et al. | |
| 4,080,096 | A | | 3/1978 | Dawson | |
| 4,098,535 | A | * | 7/1978 | Berger | 280/763.1 |
| 4,116,582 | A | | 9/1978 | Sloan | |
| 4,132,335 | A | * | 1/1979 | Ingram | 224/324 |
| 4,146,353 | A | | 3/1979 | Carrouset | |
| 4,183,721 | A | | 1/1980 | Peterson | |
| 4,222,508 | A | * | 9/1980 | Bott | 224/324 |
| 4,253,679 | A | * | 3/1981 | Sargent | 280/405.1 |
| 4,274,568 | A | * | 6/1981 | Bott | 224/319 |
| 4,323,182 | A | * | 4/1982 | Bott | 224/321 |
| 4,386,886 | A | | 6/1983 | Neal | |
| 4,402,648 | A | | 9/1983 | Kretschmer | |
| 4,427,336 | A | | 1/1984 | Lake | |
| 4,431,123 | A | * | 2/1984 | Bott | 224/321 |
| 4,433,804 | A | * | 2/1984 | Bott | 224/321 |
| 4,443,158 | A | | 4/1984 | Bentele et al. | |
| 4,449,749 | A | * | 5/1984 | Eger | 286/194 |
| 4,460,116 | A | * | 7/1984 | Bott | 224/321 |
| 4,473,178 | A | * | 9/1984 | Bott | 224/324 |
| 4,484,457 | A | | 11/1984 | Mugele | |
| 4,498,844 | A | | 2/1985 | Bissell et al. | |
| 4,512,117 | A | * | 4/1985 | Lange | 52/6 |
| 4,515,180 | A | | 5/1985 | Napolitano | |
| 4,593,840 | A | * | 6/1986 | Chown | 224/484 |
| 4,606,704 | A | | 8/1986 | Sloan | |
| 4,637,780 | A | | 1/1987 | Grayden | |
| 4,648,617 | A | * | 3/1987 | Hannappel | 280/476.1 |
| 4,648,796 | A | | 3/1987 | Maghenzani | |
| 4,687,412 | A | | 8/1987 | Chamberlain | |
| 4,762,465 | A | | 8/1988 | Friedrichs | |
| 4,781,529 | A | | 11/1988 | Rose | |
| 4,815,266 | A | * | 3/1989 | Ratzlaff et al. | 100/88 |
| 4,881,614 | A | | 11/1989 | Hoshi et al. | |
| 4,902,199 | A | | 2/1990 | McDonald et al. | |
| 4,911,348 | A | * | 3/1990 | Rasor et al. | 224/321 |
| 4,940,402 | A | | 7/1990 | McCormick | |
| 4,946,349 | A | | 8/1990 | Manabe et al. | |
| 4,981,413 | A | | 1/1991 | Elonen et al. | |
| 4,992,028 | A | | 2/1991 | Schoenwald et al. | |
| 5,078,573 | A | | 1/1992 | Peroaho et al. | |
| 5,114,312 | A | | 5/1992 | Stanislao | |
| 5,161,814 | A | * | 11/1992 | Walker | 280/414.1 |
| 5,201,487 | A | * | 4/1993 | Epplett | 248/298.1 |
| 5,242,268 | A | | 9/1993 | Fukazawa et al. | |
| 5,328,274 | A | | 7/1994 | Wallace et al. | |
| 5,346,245 | A | * | 9/1994 | Budrow et al. | 220/757 |
| 5,464,329 | A | | 11/1995 | Senoo et al. | |
| 5,480,206 | A | * | 1/1996 | Hathaway et al. | 296/36 |
| 5,489,195 | A | | 2/1996 | Domagalla et al. | |
| 5,536,147 | A | | 7/1996 | Lang | |
| 5,542,822 | A | | 8/1996 | Stretz et al. | |
| 5,580,222 | A | | 12/1996 | Bornemann | |
| 5,641,271 | A | | 6/1997 | Forrester et al. | |
| 5,660,533 | A | | 8/1997 | Cartwright | |
| 5,727,804 | A | * | 3/1998 | Metzger | 280/476.1 |
| 5,730,455 | A | * | 3/1998 | Varnum et al. | 280/404 |
| 5,794,960 | A | * | 8/1998 | Sill et al. | 280/425.2 |
| 5,795,115 | A | * | 8/1998 | Collins | 410/19 |
| 5,797,724 | A | | 8/1998 | Liu et al. | |
| 5,800,146 | A | | 9/1998 | Junemann et al. | |
| 5,806,872 | A | * | 9/1998 | Szczypski | 280/479.2 |
| 5,807,067 | A | | 9/1998 | Burdick | |
| 5,846,420 | A | | 12/1998 | Bolton et al. | |
| 5,944,216 | A | | 8/1999 | Inaoka et al. | |
| 6,224,083 | B1 | * | 5/2001 | Tyler | 180/209 |
| 6,238,153 | B1 | * | 5/2001 | Karrer | 410/102 |
| 6,315,524 | B1 | | 11/2001 | Muhs et al. | |
| 6,336,677 | B2 | * | 1/2002 | Scott | 296/198 |
| 6,354,625 | B1 | * | 3/2002 | Lambertus | 280/154 |
| 6,405,748 | B1 | * | 6/2002 | Muhs et al. | 137/351 |
| 6,409,478 | B1 | | 6/2002 | Carnes et al. | |
| 7,175,377 | B2 | * | 2/2007 | Womack et al. | 410/104 |

FOREIGN PATENT DOCUMENTS

| | | | |
|---|---|---|---|
| DE | 694694 | | 8/1940 |
| DE | 2913960 | | 10/1979 |
| DE | 3040160 | | 6/1982 |
| DE | 3840819 | | 6/1990 |
| EP | 033045 | | 9/1989 |
| EP | 0556527 | | 8/1993 |
| EP | 0606154 | A2 | 7/1994 |
| EP | 0701062 | | 3/1996 |
| FR | 1468696 | A | 2/1967 |
| FR | 2748526 | A | 11/1997 |
| GB | 1488439 | | 10/1977 |
| GB | 1542483 | | 3/1979 |
| GB | 2147050 | | 5/1985 |
| GB | 2181487 | A | 4/1987 |
| GB | 2303178 | A | 2/1997 |
| JP | 63186985 | | 8/1988 |
| SU | 779643 | | 11/1980 |
| WO | WO 93/01396 | | 1/1993 |
| WO | WO 98/16403 | | 4/1998 |

OTHER PUBLICATIONS

Godwin Pumps, Dri-Prime Contractors Pumps brochure, 4 pages, dated prior to Mar. 22, 1999.

SPP Pumps Ltd., Hydrostream Horizontal Split Case Pumps brochure, 6 pages, dated prior to Mar. 22, 1999.

SPP Pumps Ltd., Literature Folio, 96 pages, dated prior to Mar. 22, 1999.

Source unknown, "Principles of Operation", p. 2, dated prior to Mar. 22, 1999.

Source unknown, Pumping of Liquids and Gases, p. 6-24, dated prior to Mar. 22, 1999.

Parma Pompe, Omega.S brochure, 8 pages, dated prior to Mar. 22, 1999.

Neyrtec—Alstrhom Atlantique: "Hydro Vakuumpumpen und -verdichter der Reihen NS-CNS," S.A. Imp. Boissy & Col0mb., Grenoble XP002253993, Jul. 1979. (No English translation. This article is relevant because it was cited on the Supplementary European Search Report.).

W.H. Faragallah: "Liquid ring vacuum pumps and compressors," 1986, Beltz Offsetdruck, 6944 Hemsbach/Bergstrasse XP002253992, p. 77, Paragraph 5.2.2, p. 78, figure 5.4.

* cited by examiner

TRAILER AND FUEL TANK ASSEMBLY

This application is a divisional of U.S. patent application Ser. No. 09/532,338, filed Mar. 21, 2000, now U.S. Pat. No. 6,405,748 entitled TRAILER AND FUEL TANK ASSEMBLY, which claims priority to U.S. Provisional Patent Application Ser. No. 60/125,559, filed Mar. 22, 1999, and entitled, PUMP ASSEMBLY AND RELATED COMPONENTS.

FIELD OF THE INVENTION

The present invention relates generally to pumps. More particularly, the present invention relates to fuel tanks and trailers for use with pumping systems.

BACKGROUND OF THE INVENTION

This invention relates to the field of pumps, and more particularly, to industrial type pumps and related pump components. One application for industrial type pumps is ground water control during excavation. Prior to beginning excavation, a plurality of well points may be driven into the ground proximate the proposed excavation. A pump may be coupled to the well points to remove the ground water proximate the excavation site. In this type of application it is often desirably to allow the pump to run continuously for several days.

When the pump is powered by a motor such as a diesel motor, it is necessary to supply the appropriate fuel for the motor. In many cases a fuel tank is provided to supply the motor with fuel during its operation. Over time, contaminates may accumulate in the fuel tank. Examples of contaminates include water, sand, and sediment. Contaminates in the fuel tank are undesirable, since they may cause the motor to stop running and/or damage the motor. Prior to beginning a pumping operation, it is often necessary to transport the pump and the fuel to the excavation site.

SUMMARY OF THE INVENTION

The present invention provides a pumping system for pumping water, sewage or other pumped material from one location to another. The pumping system includes a motor coupled to a centrifugal pump for driving the centrifugal pump. The motor and the centifugal pump are preferably commonly fixed to a trailer.

In one illustrative embodiment, the trailer includes an elongated fuel tank. More preferably, the fuel tank forms the body of the trailer. The fuel tank may include a recess in the top surface for receiving the motor and/or pump. This lowers the pump toward the ground, which increases the suction performance of the pump. The bottom surface of the fuel tank may be bowed upward. This causes any contaminants in the fuel tank to collect along the edges of the tank. Drain ports, which are provided proximate the edges of the tank, may then be used to drain the contaminants from the tank. The bowed bottom surface also provides strength to the tank.

To attach certain accessories to the trailer including axles, jack stands, fenders, trailer tongues, lifting bails, etc., the trailer may include one or more track bars mounted thereto. The track bar preferably includes an elongate channel and an elongate slot extending into the channel. By placing an insert inside of the channel and bolting an accessory to the insert through the longitudinally extending slot, the accessories can be easily attached to the trailer. In addition, because the slot extends along the length of the track bar (either the complete length or a portion thereof), the accessories can be selectively attached anywhere along the track bar. This may allow optimum placement of the accessories along the length of the trailer.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the Figures thereof and wherein.

DETAILED DESCRIPTION OF THE PREFERRED EMBODIMENTS

The following detailed description should be read with reference to the drawings, in which like elements in different drawings are numbered in like fashion. The drawings which are not necessarily to scale, depict selected embodiments and are not intended to limit the scope of the invention. In some cases, the drawings may be highly diagrammatic in nature. Examples of constructions, materials, dimensions, and manufacturing processes are provided for various elements. Those skilled in the art will recognize that many of the examples provided have suitable alternatives which may be utilized.

Figure 1:
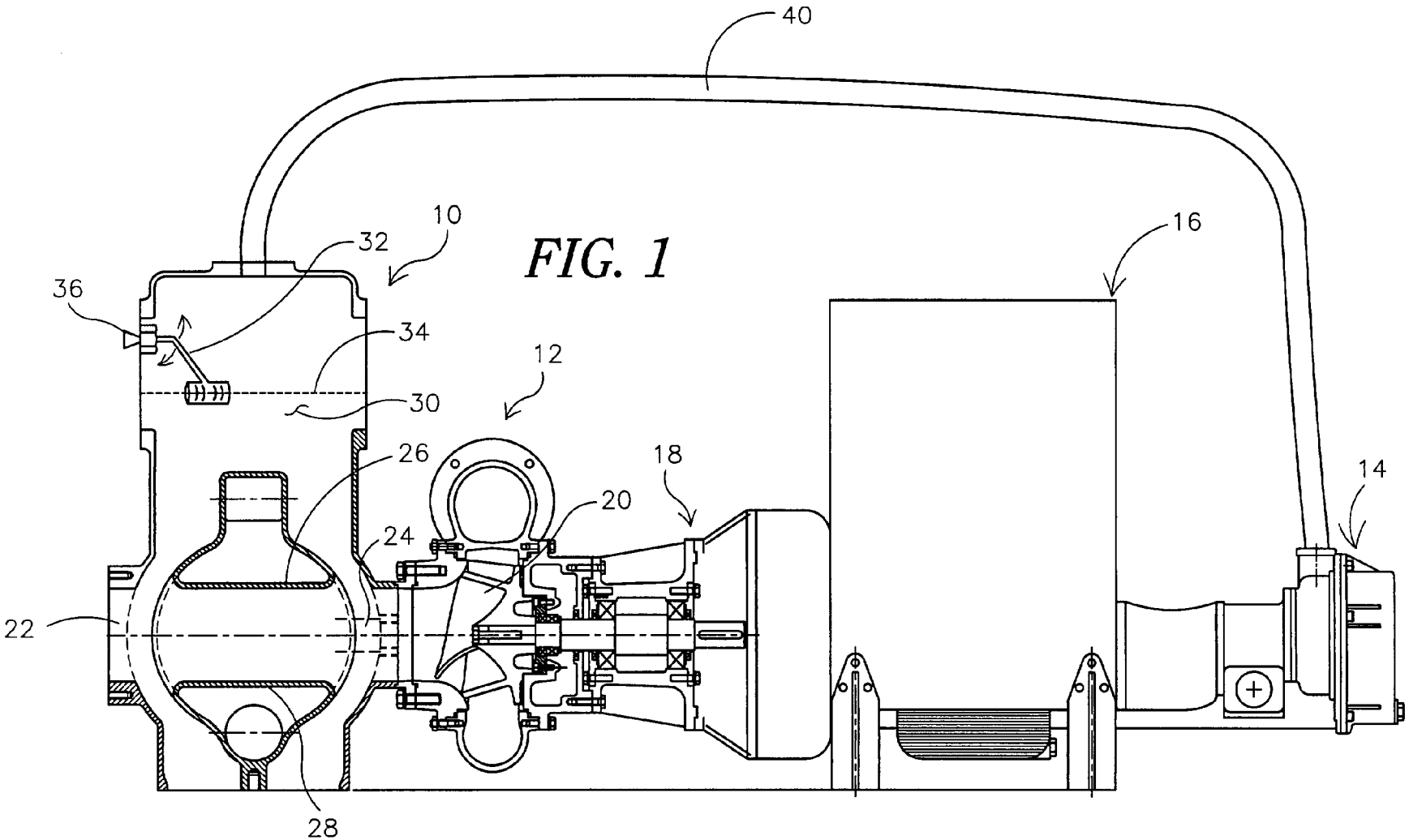
FIG. 1 is a partial cross-sectional side view of a pump assembly in accordance with a preferred embodiment of the present invention.

The present invention provides an improved pump-assembly and related components. The improved pump assembly is generally shown in FIG. 1 and includes a separator 10, a centrifugal primary pump assembly 12, a liquid ring vacuum pump 14 and a motor 16.

The separator 10 includes an intake port 22 and an output port 24. The intake port 22 is the input port for the pump. The intake port 22 and the output port 24 preferably have substantially the same dimension and shape to provide a smooth flow path for the pumped material. Flow directors 26 and 28 are part of a tube having a diameter which is similar to the diameter of an eye of the impeller. This may help further direct the flow through the separator 10 and in a straight line with the impeller.

Extending above the intake port 22 and the output port 24 is reservoir 30. Reservoir 30 stores a reservoir of pumped material for maintaining the pump's prime during short intermittent disruptions of the pumped material. The pump is first primed by creating a vacuum in the reservoir 30 using the liquid ring vacuum pump 14 and interconnecting hose 40. The vacuum provided by the vacuum pump assembly 14 initially creates and then maintains an optimum level 34 of pumped material in reservoir 30.

A float system 32 is used to maintain the optimum level 34 of pumped material in the reservoir 30. If the level of pumped material in the reservoir 30 exceeds the optimum level 34, the float system opens a valve 36 or the like to the outside to reduce the vacuum in the reservoir 30. Once the valve is open, the primary pump assembly 12 removes more of the pumped material from the reservoir 30, thereby reducing the level in the reservoir 30. If the level of the pumped material falls below the optimum level 34, the float system closes the valve 36, thereby allowing the vacuum pump assembly 14 to increase the vacuum in the reservoir 30, which in turn, increases the level in the reservoir 30.

For optimum pump performance, the float system 32 should be neither under-dampen or over-dampen. If the float system 32 is over-dampened, the float system may be slow to respond to changes in the level of reservoir 30. Hence, the reservoir 30 may become overly full or overly empty during normal operation.

If the reservoir 30 becomes overly full, some of the pumped material may be forced into the vacuum pump 14 through hose 40. This can contaminate the water used in the liquid lubricated vacuum pump, and can result in the discharge of some of the pumped material from the vacuum pump discharge onto the ground. If the reservoir 30 becomes overly empty, the pump may become at least momentarily unprimed. This can reduce the efficiency of the pump.

In contrast, if the float system 32 is under-dampened, the float system 32 may respond to quickly to changes in the level of reservoir 30. This can cause the valve 36 to remain open much of the time, thereby reducing the efficiency of the pump. As can readily be seen, the float system 32 must be carefully designed to achieve optimum pump performance. In the present invention, this is achieved by optimizing the weight, shape and dimensions of the float system 32.

Once properly primed, the primary pump assembly 12 draws the pumped material through the separator 10, and directs the pumped material out of a discharge port. A further discussion of the primary pump assembly 12 is provided below.

The primary pump assembly 12 is preferably directly coupled to the flywheel of the motor 16 through an oil lubricated bearing housing 18. The oil lubricated bearing housing 18 transfers the power directly from the motor 16 to the impeller 20 of the primary pump assembly 12. By directly coupling the motor 16 to the primary pump assembly 12, no belts are required. In addition, the alignment between the motor 16 and the primary pump assembly 12 is fixed by the bearing housing 18, which reduces bearing wear. Both of these tend to increase the overall reliability of the pump. Although not preferred, it is contemplated that the bearing housing 18 may include a mechanism for gearing up or gearing down the speed of the impeller 20 relative to the RPM's of the motor 16.

For similar reasons discussed above, the liquid ring vacuum pump 14 is also preferably directly driven by motor 16. In FIG. 1, the liquid ring vacuum pump 14 is driven off the opposite side of the drive shaft of motor 16. If motor 16 does not provide access to both sides of the drive shaft, vacuum pump 14 may be directly driven using an optional bevel gear provided off bearing housing 18, as shown for example, in FIG. 18 below. It is contemplated that the motor 16 may be any type of motor including a combustion motor or an electric motor. Preferably, however, the motor 16 is a diesel motor such as a Deutz™, Detroit VM™ Sun Diesel, Caterpillar® or John Deere® motor.

Figure 2:
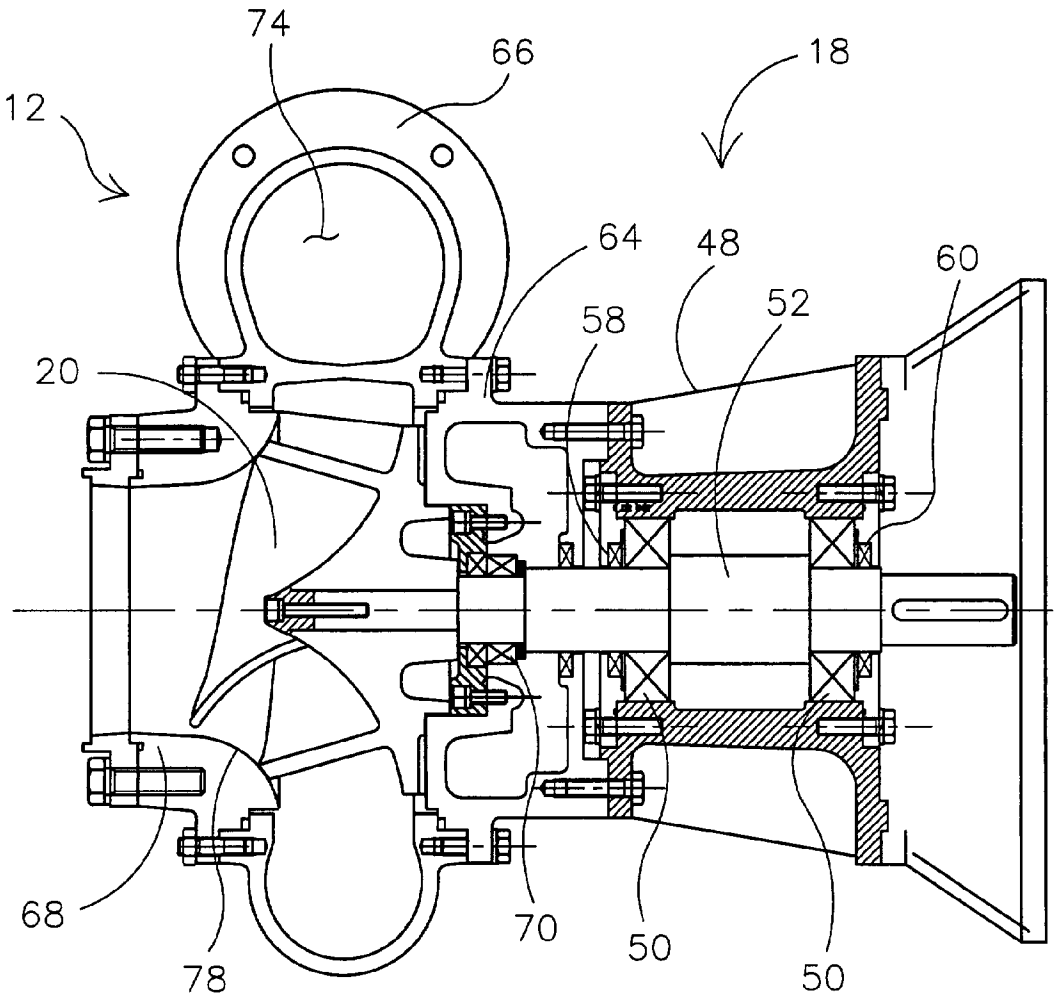
FIG. 2 is an enlarged partial cross-sectional side view of the primary pump assembly and bearing housing of FIG. 1.

FIG. 2 is an enlarged partial cross-sectional side view of the primary pump assembly 12 and bearing housing 18 of FIG. 1. As indicated above, the bearing housing 18 directly transfers the power from the motor 16 to the impeller 20 of the primary pump assembly 12. The bearing housing 18 includes bearings 50 and drive shaft 52. Oil used to lubricate bearings 50 is preferably sealed between the front oil seal 58 and the rear oil seal 60.

The primary pump assembly 12 preferably includes a back plate 64, a volute 66 and an adjustable front plate 68. The back plate 64 and front plate 68 are sometimes referred to as wear plates. The drive shaft 52 extends through the back plate 64 and drives the impeller 20. The back plate 64 preferably includes a rear seal 70 around the drive shaft 52 to prevent pumped material from escaping therethrough. The impeller 20 drives the pumped material from the separator 10 into the volute discharge cavity 74. At the end of the volute discharge cavity 74 is the discharge port of the pump.

Figure 3:
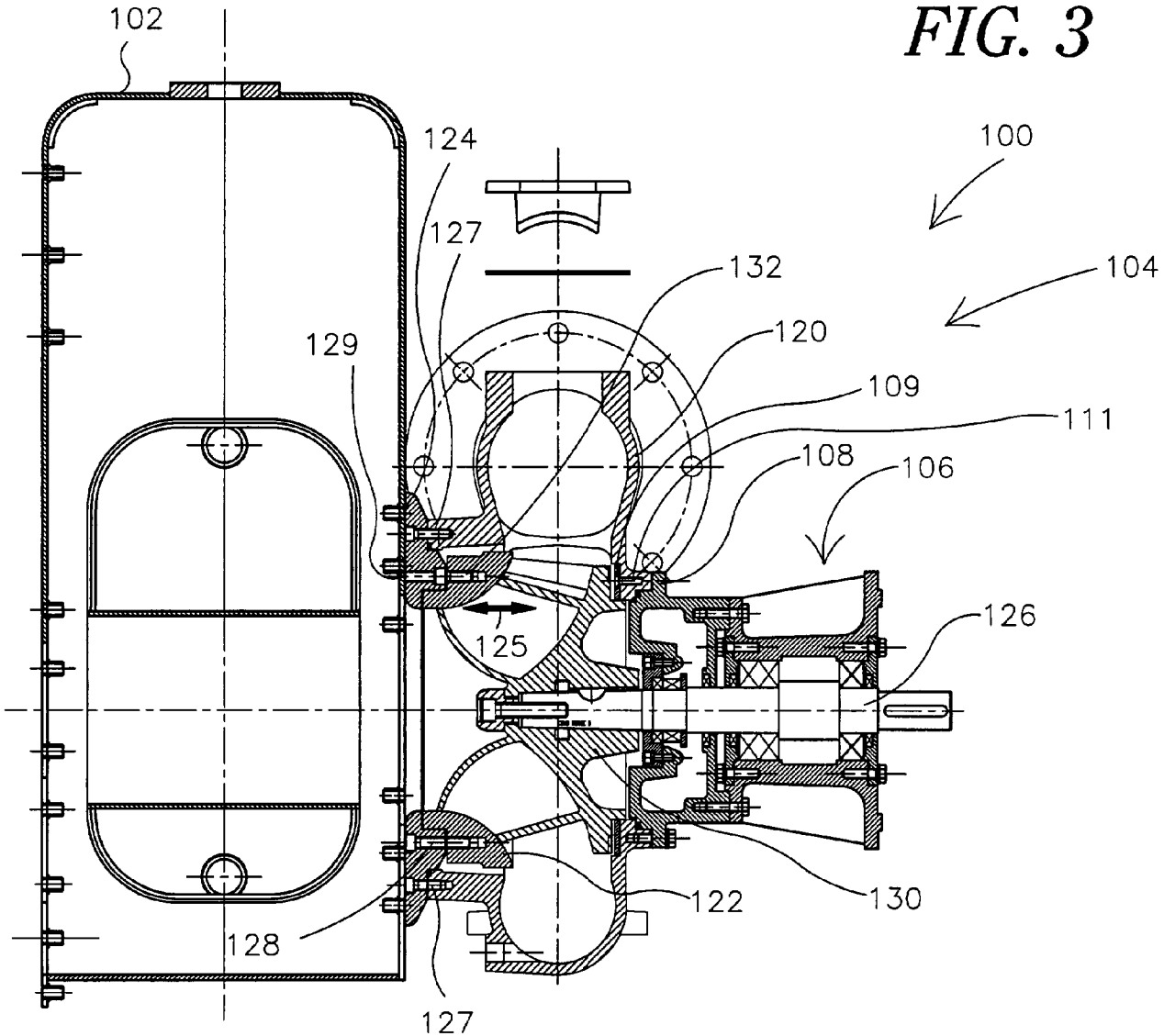
FIG. 3 is a partial cross-sectional side view of an additional embodiment of a pump assembly in accordance with the present invention.

FIG. 3 is a partial cross-sectional side view of an additional embodiment of a pump assembly 100 in accordance with the present invention. Pump assembly 100 includes a primary pump assembly 104, a bearing housing 106, and a separator 102. Primary pump assembly 104 includes a back plate 108, a back wear plate 109, a volute 120, a front plate 122, and a mounting flange 124.

A drive shaft 126 extends through back plate 108 and drives an impeller 130. Mounting flange 124 is preferably fixed to separator 102 by a plurality of fasteners (not shown) and to volute 120 via a plurality of fasteners 127. Front plate 122 is fixed to mounting flange 124 by a plurality of pull screws 128.

As illustrated by arrow 125, front plate 122 can preferably be adjusted toward or away from impeller 130. In a preferred embodiment, the position of front plate 122 may be adjusted utilizing a plurality of pull screws 128, and a plurality of push screws 132. For purposes of illustration, one pull screw 128 and one push screw 132 are shown in FIG. 3. A top 129 of push screw 132 is seated against mounting flange 124. Rotating push screw 132 in a counter clockwise direction will cause push screw 132 to urge front plate 122 away from mounting flange 124. Front plate 122 may be fixed in the desired position by tightening pull screws 128.

Back wear plate 109 is fixed to an inner surface of volute 120 by a plurality of fasteners 111. This may allow the impeller to extend laterally beyond the back plate 108. The position of back wear plate 109 may be adjusted to compensate for wear. Various methods of adjusting the position of back wear plate 109 may be utilized without deviating from the spirit and scope of the present invention. For example, a plurality of shims may be placed between back wear plate 109 and volute 120. Embodiments of the present invention have also been envisioned in which the position of back wear plate 109 may be adjusted utilizing a plurality of push screws and a plurality of pull screws. In this envisioned embodiment, the position of back wear plate 109 may be adjusted using a method similar to the method described above for adjusting the position of front plate 122.

Figure 4:
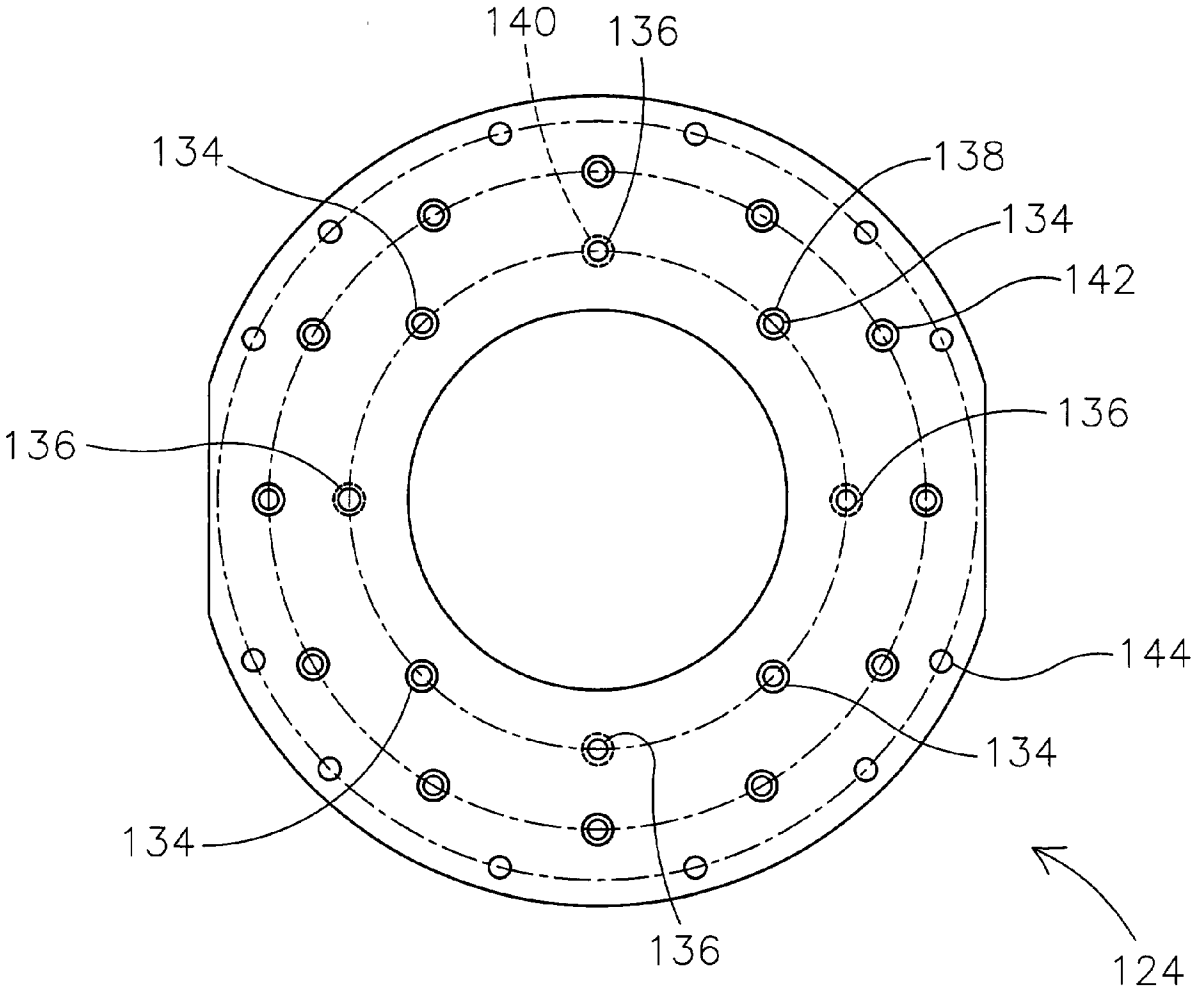
FIG. 4 is a plan view of a mounting flange in accordance with an exemplary embodiment of the present invention.

FIG. 4 is a plan view of mounting flange 124. Mounting flange 124 defines a plurality of front plate mounting holes 134 and a plurality of adjustment holes 136. Each front plate mounting hole 134 includes a counter bore 138 which is adapted to accept the head of a pull screw 128. Likewise, each adjustment hole 136 includes a bore 140 which is adapted to accept the head of an push screw 132. Counter bore 138 of each front plate mounting hole 134 is defined by a front face of mounting flange 124, and the counter bore 140 of each adjustment hole 136 is defined by a back face of mounting flange 124.

Figure 5:
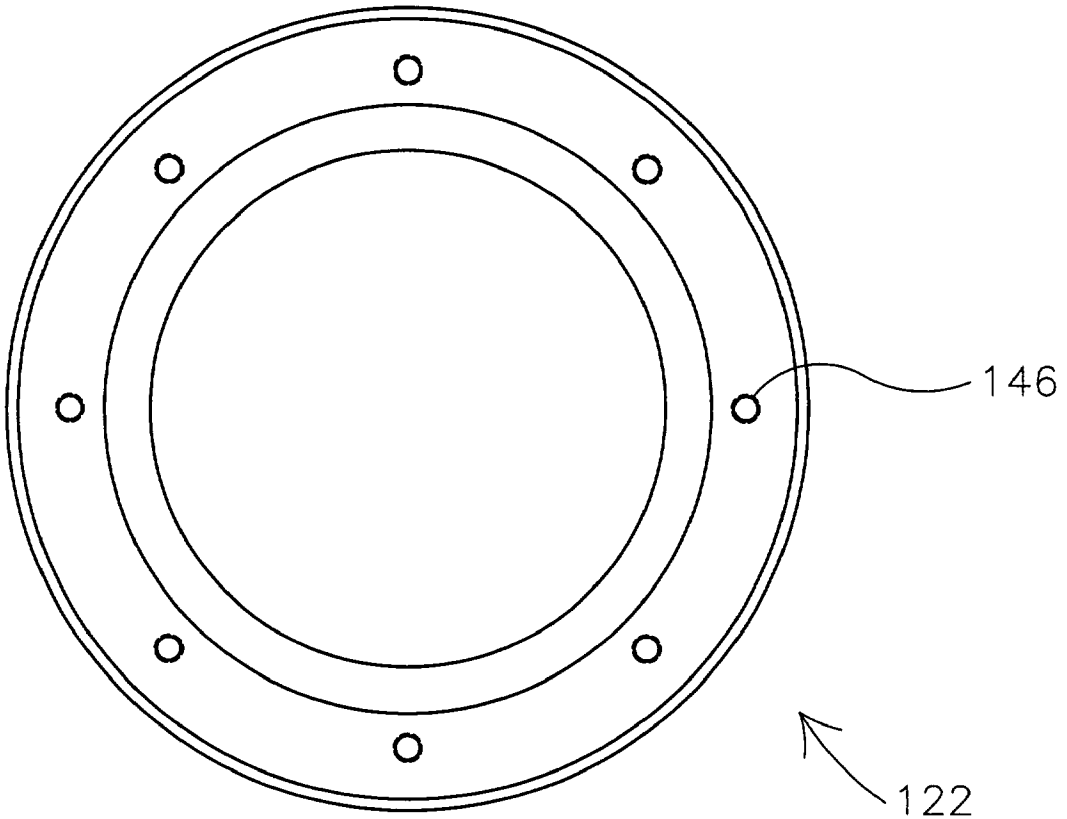
FIG. 5 is a plan view of a front plate in accordance with an exemplary embodiment of the present invention.

Mounting flange 124 also preferably defines a plurality of volute mounting holes 142. In a preferred embodiment of pump assembly 100, volute mounting holes 142 are adapted to accept fasteners which fix mounting flange 124 to volute 120. Mounting flange 124 also defines a plurality of separator mounting holes 144. Like the volute mounting holes 142, separator mounting holes 144 are adapted to accept fasteners which fix mounting flange 124 to separator 102. FIG. 5 is a plan view of front plate 122 of FIG. 3, with a plurality of threaded holes 146 that are adapted to accept pull screws 128 and push screws 132.

Figure 6:
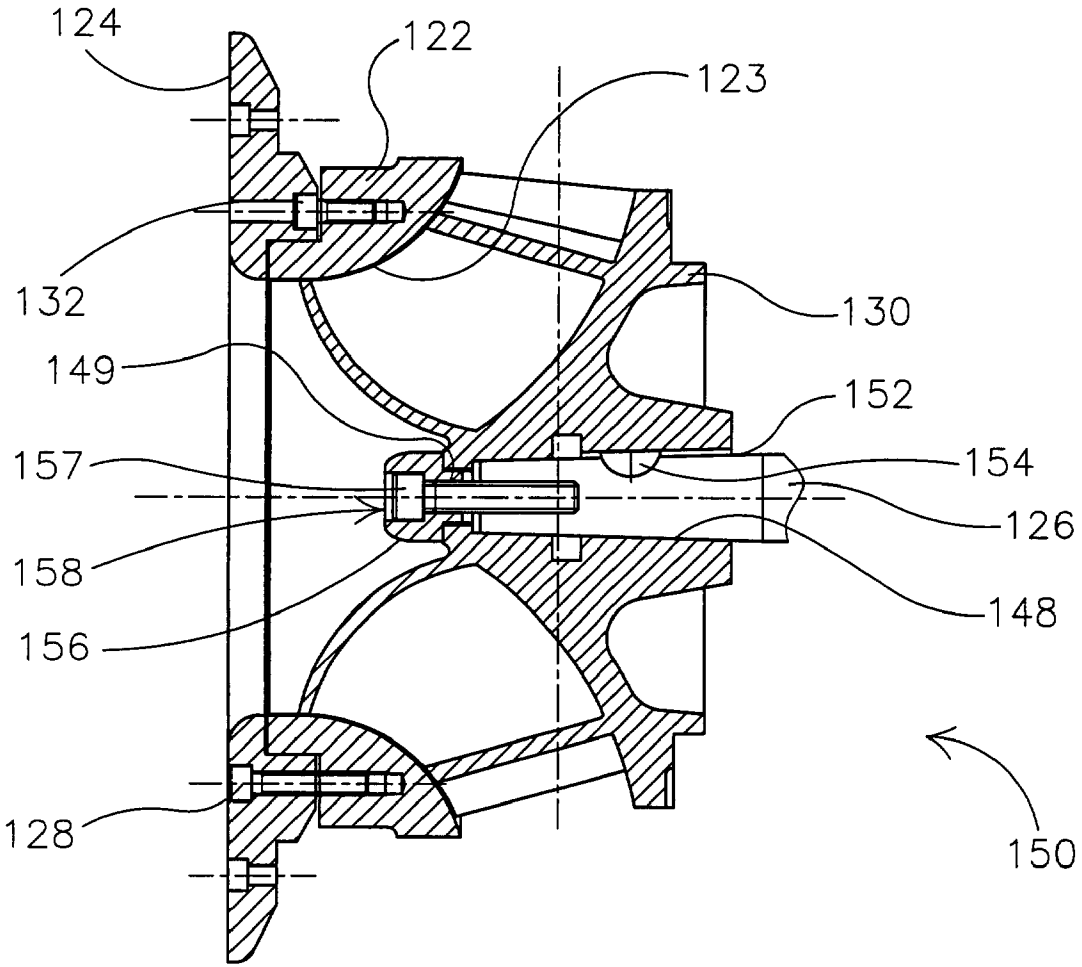
FIG. 6 is a cross-sectional side view of an assembly in accordance with an exemplary embodiment of the present invention.

FIG. 6 is a cross-sectional side view of an assembly 150 in accordance with the present invention. Assembly 150 includes mounting flange 124 which is fixed to front plate 122 with a plurality of pull screws 128. In FIG. 6, front plate 122 is in an outward position. Front plate 122 may be selectively moved to an inward position by loosening pull screws 128 and rotating a plurality of push screws 132, as shown in FIG. 7.

Figure 7:
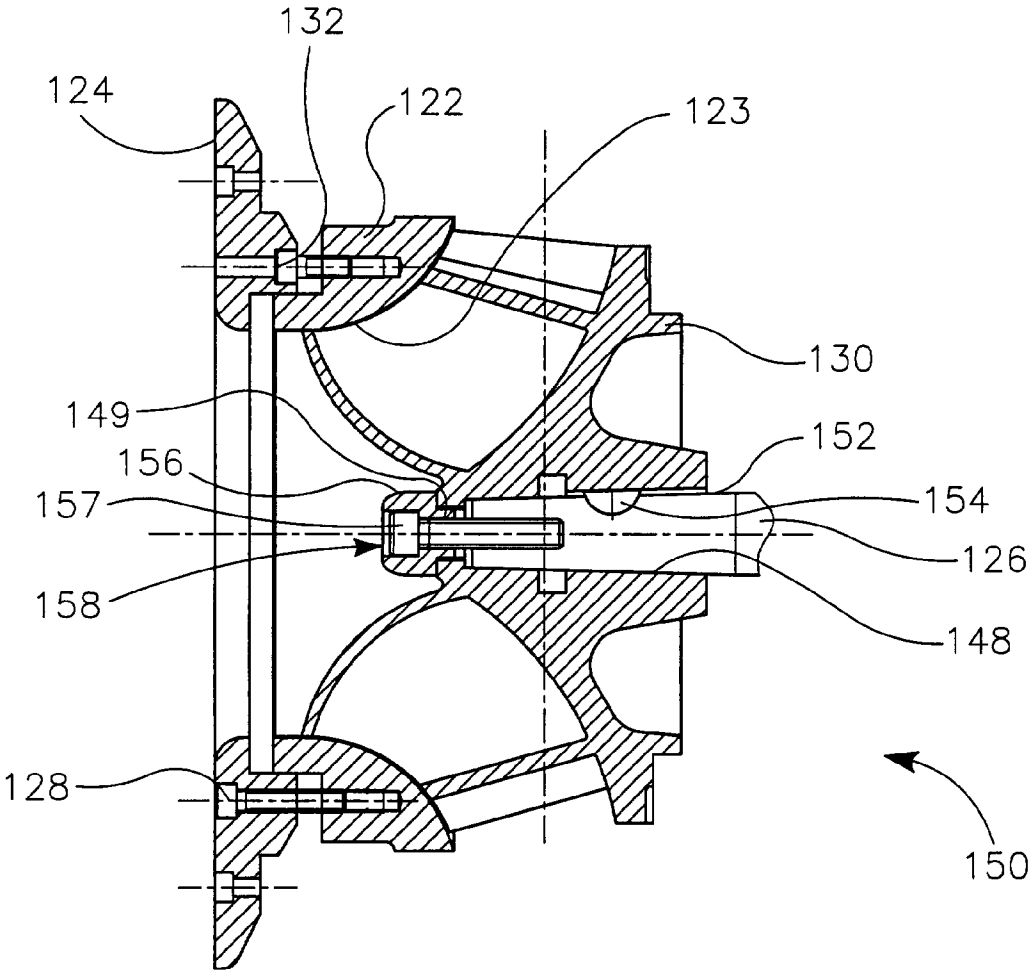
FIG. 7 is a cross-sectional side view of an assembly in accordance with an exemplary embodiment of the present invention.

Assembly 150 of FIG. 6 and FIG. 7 also show an impeller 130 defining a bore 148 and a keyway 152. A drive shaft 126 is disposed in bore 148, and a key 154 is disposed in keyway 152. An impeller fastener 157 is utilized to fix impeller 130 to drive shaft 126. A rounded cap 156 is disposed about ahead portion 158 of impeller fastener 157. Rounded cap 156 makes the pump less prone to clogging, because fibrous and stringy materials such as rags are less likely to become wrapped around rounded cap 156 and clog the pump. Impeller 130 also defines a thread 149.

In a preferred embodiment, thread 149 is adapted to threadingly engage a jack bolt (not shown). In a method in accordance with the present invention, a jack bolt may be utilized to remove impeller 130 from the drive shaft 126. The jack bolt may be turned into thread 149 until it is seated against a distal end of drive shaft 126. The jack bolt may be turned further to urge impeller 130 distally away from the drive shaft 126.

To reduce turbulence, cavitation and clogging in the pump, impeller 130 preferably includes two interlocking spiral blades. The spiral impeller design efficiently drives the pumped material from the separator 102 into the volute discharge cavity, and also helps reduce clogging of the pump caused by rags or other fibrous or stringy materials. The fibrous and stringy materials are more efficiently passed through the impeller and into the volute discharge cavity.

The front plate 122 preferably has a rounded inner surface 123. Rounded inner surface 123 provides a smooth transition between the separator 102 and the volute discharge cavity. Preferably, the volute, impeller 130 and front plate 122 are all designed to provide a smooth flow path from the separator, through the impeller and into the volute discharge cavity. This smooth flow path may increase the efficiency of the pump while reducing damage to the impeller, wear plates, bearings and shaft. A further discussion for a preferred flow path configuration is described below with reference to FIG. 11.

The outward ends of the two interlocking spiral blades of the impeller 130 preferably are in close tolerance (preferably 30 mils or less) to the rounded inner surface 123 of front plate 122. Such a tolerance is difficult to maintain over extended periods because during use the two interlocking spiral blades tend to become worn. This wear increases the gap between the spiral blades and rounded inner surface 123 of the front plate 122. To correct for this, the position of front plate 122 may be adjusted as describe above.

Figure 8:
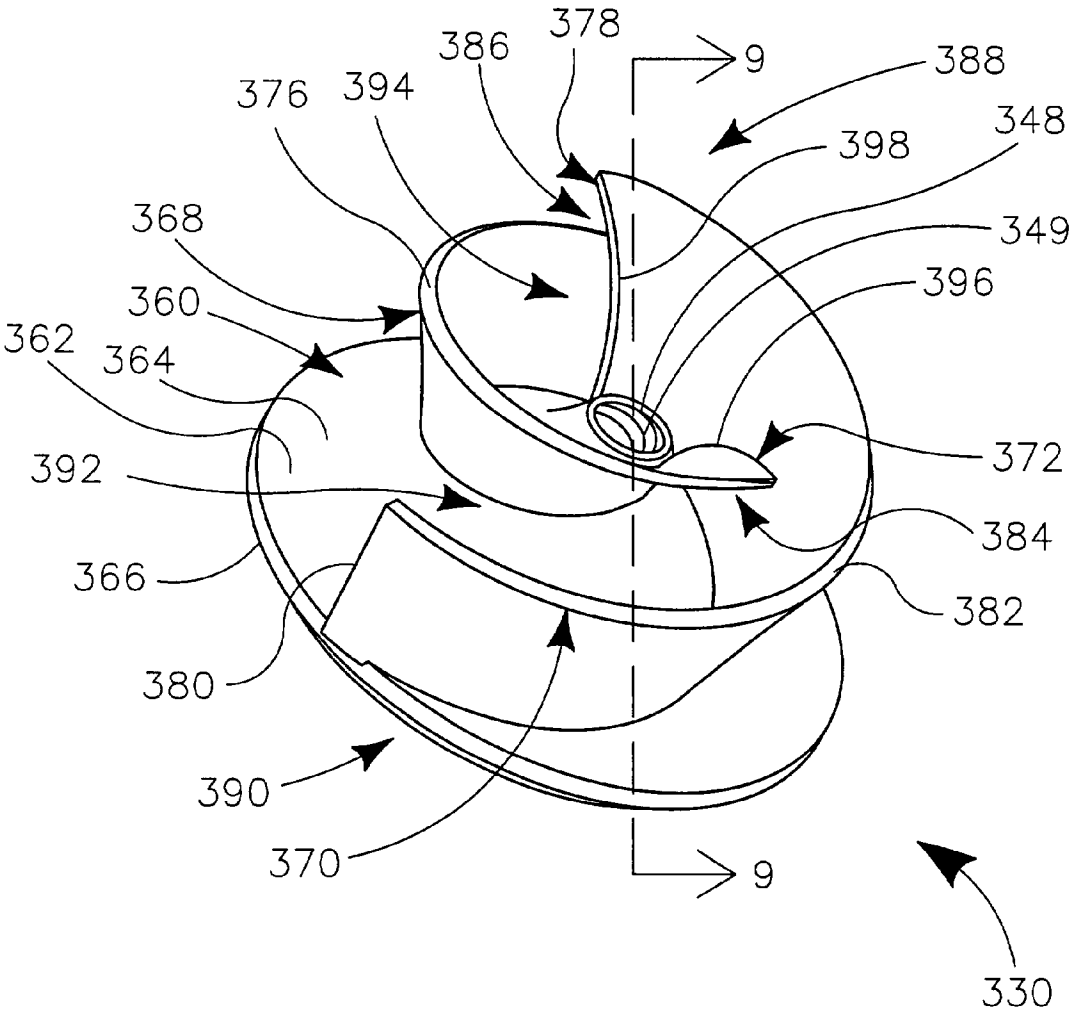
FIG. 8 is a perspective view of an impeller in accordance with an exemplary embodiment of the present invention.

FIG. 8 is a perspective view of an impeller 330 in accordance with the present invention. Impeller 330 includes a core member 360 having a front face 362, a back face 366, and a central bore 348 extending therebetween. Central bore 348 is preferably adapted to receive a drive shaft. Impeller 330 preferably defines a thread 349 proximate a distal end of central bore 348. As described above, the thread 349 can be used in conjunction with a jack screw to remove the impeller 330 from the drive shaft.

Front face 362 of core member 360 preferably defines a curved surface 364, such as a toroidal surface. A first blade 368 and a second blade 370 are fixed to front face 362 of core member 360. In the embodiment shown in FIG. 8, the first blade 368 and the second blade 370 each have a generally spiral shape. First blade 368 includes a leading edge 372, a trailing edge 374 (not visible in FIG. 8), and a top edge 376. Likewise, second blade 370 includes a leading edge 378, a trailing edge 380, and a top edge 382.

The first blade 368 also includes a leading portion 384 proximate leading edge 372, and a trailing portion 386 proximate trailing edge 374. Likewise, second blade 370 includes a leading portion 388 proximate leading edge 378, and a trailing portion 390 proximate trailing edge 380. Preferably, leading portion 384 of first blade 368 radially overlaps trailing portion 390 of second blade 370. Likewise, leading portion 388 of second blade 370 preferably radially overlaps trailing portion of first blade 368.

As such, impeller 330 may include a first channel 392 defined by the leading portion 384 of the first blade 368, the trailing portion 390 of the second blade 370, and the front face 362 of the core member 360. Impeller 330 may also include a second channel 394 defined by the leading portion 388 of the second blade 370, the trailing portion 386 of the first blade 368, and the front face 362 of the core member 360.

In the embodiment shown, the first leading edge 372 of the first blade 368 defines a radius 396, and leading edge 378 of second blade 370 defines a radius 398. Radius 396 is preferably equal to radius 398. The amount of curvature of each blade preferably gradually decreases toward the trailing edge of the blade.

Figure 9:
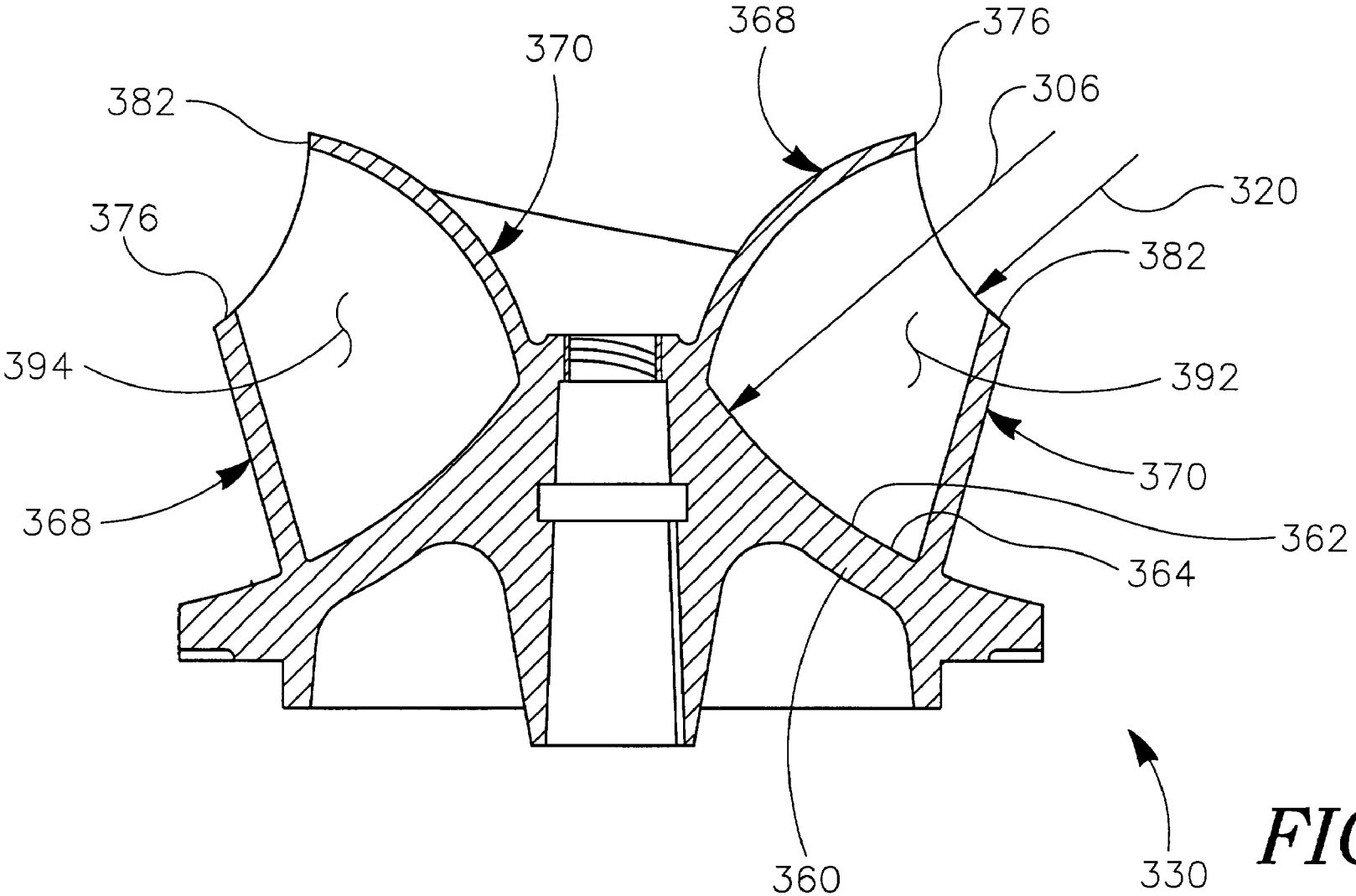
FIG. 9 is a cross-sectional side view of the impeller of FIG. 8.

FIG. 9 is a cross-sectional side view of impeller 330 of FIG. 8, taken along line 9-9. As described above, impeller 330 includes a core member 360 having a front face 362 defining a curved surface 364 such as a toroidal surface. Curve surface 364 may have a uniform curve defining a radius 306. The top edge 376 of the first blade 368 and the top edge 382 of the second blade 370 preferably define a toroidal surface with a radius 320 as they spiral around core member 360. In a preferred embodiment, radius 320 is smaller than the radius 306 of the curved front face 362. The first channel 392 and the second channel 394 defined by the first blade 368 and the second blade 370 are also visible in FIG. 9.

Figure 10:
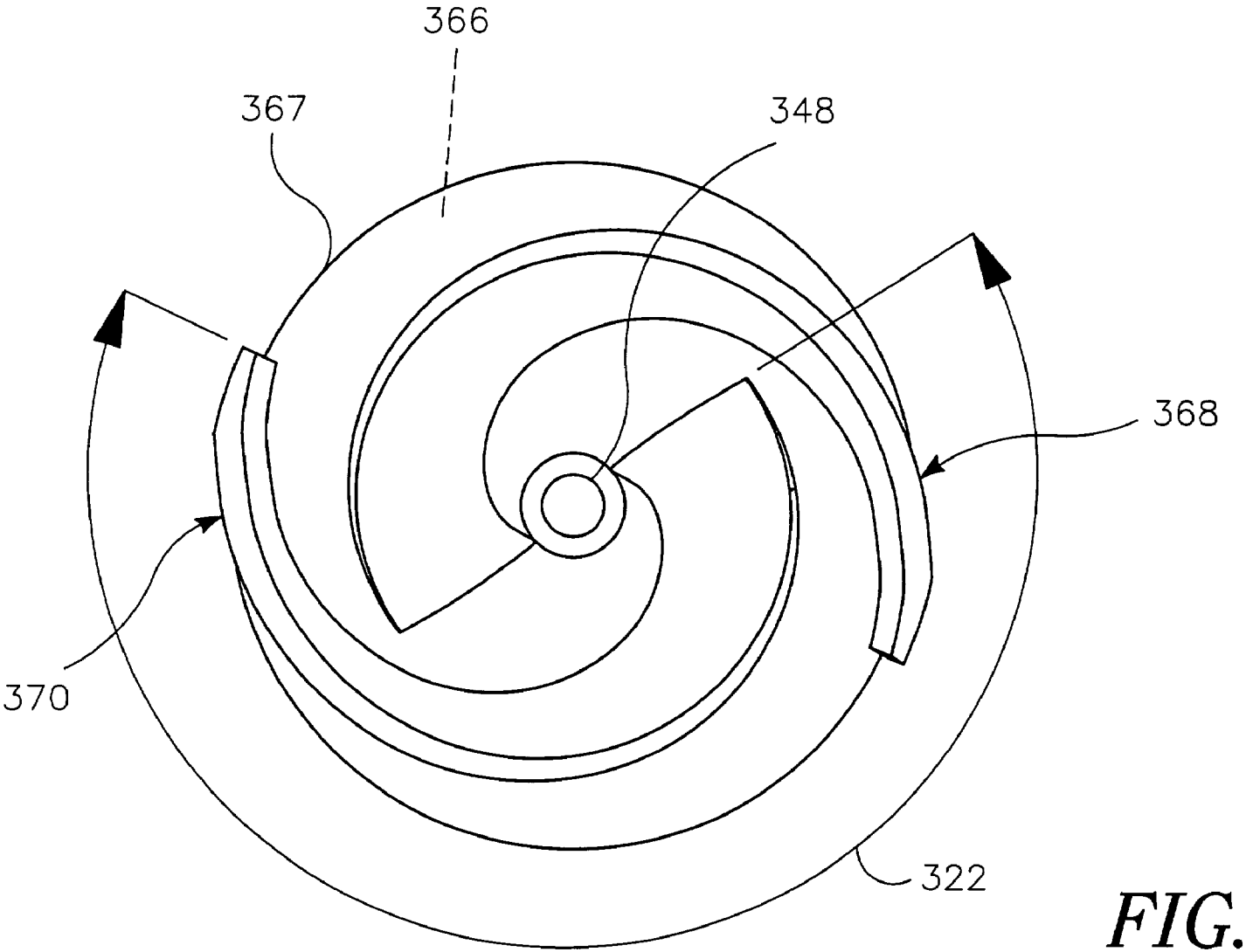
FIG. 10 is a plan view of the impeller of FIG. 8.

FIG. 10 is a plan view of the impeller 330 of FIG. 8 and FIG. 9. In FIG. 10 it may be appreciated that first blade 368 and second blade 370 each extend from near the central bore 348 to near the outer edge 367 of the back face 366 in a spiral or semi-circular shape. An angular extent 322 of the second blade 370 is illustrated in FIG. 10. In a preferred embodiment, the first blade 368 and the second blade 370 each extend more than 180 degrees around the central bore 348, and preferably in the range of 180 degrees to 360 degrees. In a particularly preferred embodiment, the first blade 368 and the second blade 370 each extend about 225 degrees around the central bore 348. Also in a preferred embodiment, the first blade 368 and the second blade 370 are each tilted away from the axis of the central bore 348, with the amount of tilt decreasing toward the trailing ends of the blades. This shape and configuration is believed to maximize pump efficiency and reduce the likelihood of cavitation.

Cavitation typically occurs when there is a localized area of low pressure within the fluid in the pump. When the pressure at a particular point is reduced to the vapor pressure of the liquid being pumped a bubble forms. During cavitation many bubbles may form, and subsequently collapse. When a bubble collapses, a localized area of very high pressure is formed. The very high intermittent pressures created during cavitation may damage portions of the pump which are near the cavitation. Thus, for example, cavitation has been known to cause pitting of an impeller. Cavitation may also reduce the efficiency of a pump, as energy is wasted in producing the cavitation and disrupting the smooth flow of the fluid through the pump.

Figure 11:
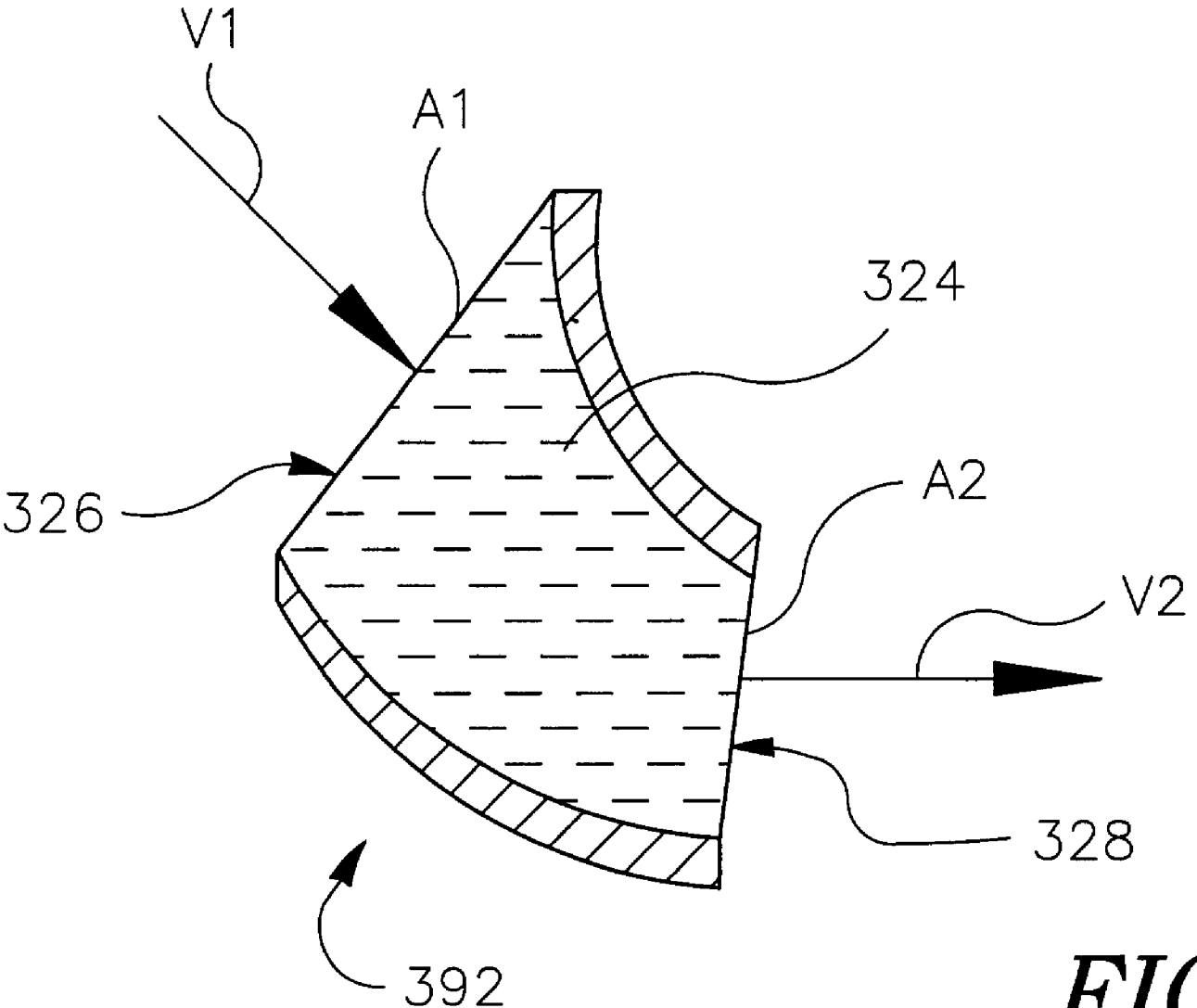
FIG. 11 is a diagrammatic representation of a flow channel in accordance with the present invention.

FIG. 11 is a diagrammatic representation of a flow channel 392 in accordance with a preferred embodiment of the present invention. A fluid 324 is disposed in flow channel 392. Flow channel 392 includes a channel inlet 326 and a channel outlet 328. Channel inlet 326 has a lateral cross-sectional area of A1. Channel outlet 328 has a lateral cross-sectional area of A2, where A2 is smaller than A1. The velocity of the fluid entering channel inlet 326 is represented by arrow V1, and the velocity of the fluid exiting channel outlet 328 is represented by arrow V2, where V2 is larger than V1. In a preferred embodiment, the lateral cross-sectional area of flow channel 392 decreases as the velocity of fluid 324 increases. Such that, the volume rate of flow of fluid 324 is substantially constant through flow channel 392. Likewise, the pressure of the fluid 324 is preferably substantially constant through flow channel 392. This is believed to produce the most efficient flow path for the pumped material. To accomplish this, both the impeller and the front wear plate are preferably designed to produce a flow channel that satisfies these requirements.

Figure 12:
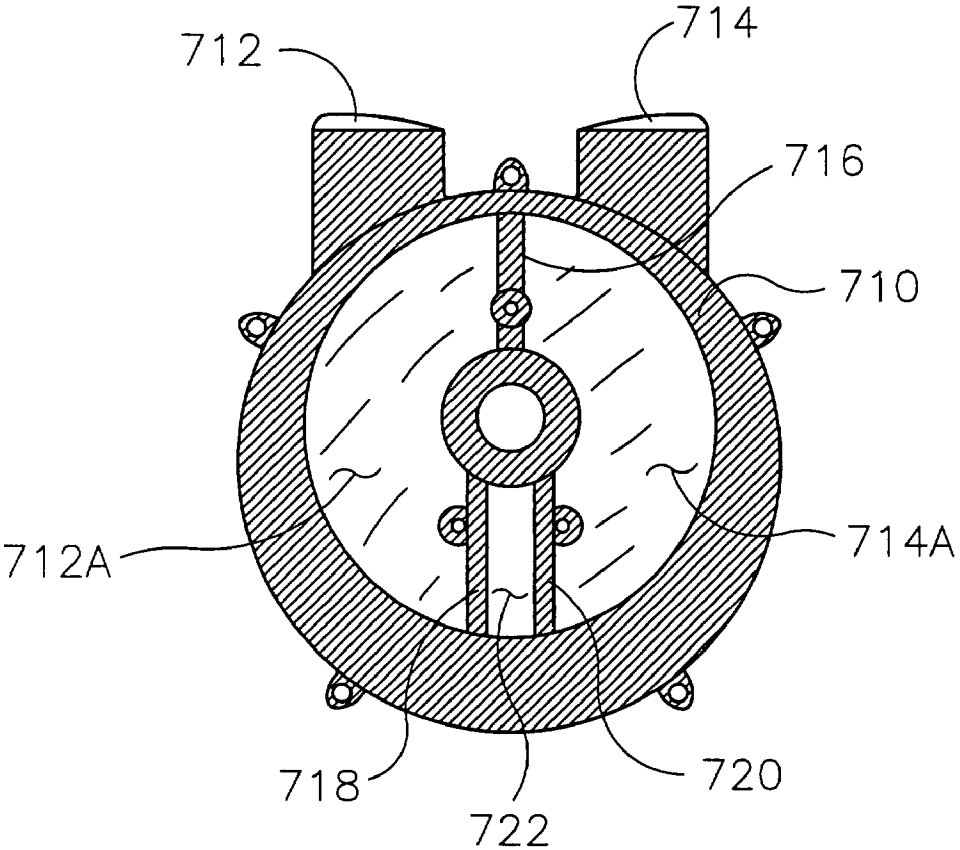
FIG. 12 is a top view of the base plate of a liquid ring vacuum pump assembly in accordance with an exemplary embodiment of the present invention.

FIG. 12 through FIG. 16 show various components of the liquid ring vacuum pump assembly 14 of FIG. 1. The liquid ring vacuum pump 14 includes a base plate 710, a port plate 730, an impeller 738 and a cover 750. FIG. 12 is a top view of a base plate 710. Base plate 710 includes an intake bore 714 that is in fluid communication with an intake chamber 712A, and a discharge bore 712 that is in fluid communication with a discharge chamber 714A. Walls 716, 718 and 720 separate the intake chamber 712A from the discharge chamber 714A. A water intake chamber 722 is defined between walls 718 and 720, as shown. The water intake chamber 722 is preferably in fluid communication with a water intake bore (not shown).

Figure 13:
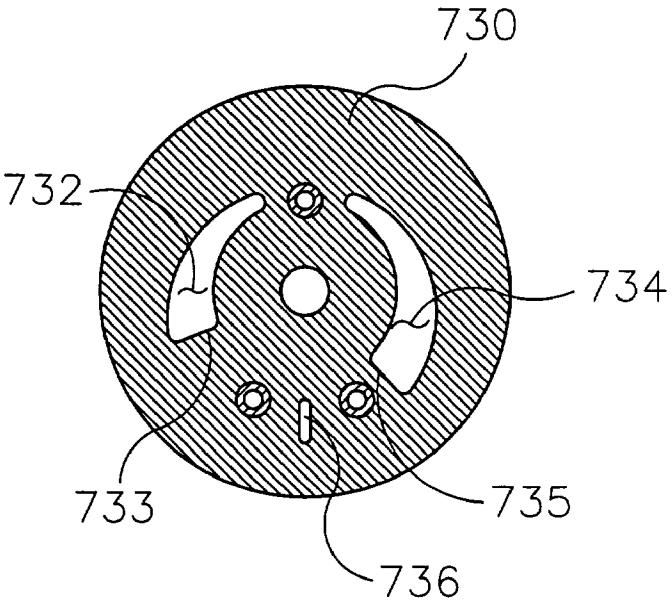
FIG. 13 is a top view of a port plate of a liquid ring vacuum pump assembly in accordance with an exemplary embodiment of the present invention.

FIG. 13 is a top view of a port plate 730, which is bolted to the base plate 710 of FIG. 12. The port plate 730 separates and covers the intake chamber 712A, the discharge chamber 714A and the water intake chamber 722. The port plate 730 includes, an intake port 734, a discharge port 732 and a water intake port 736. The intake port 734 provides access to the intake chamber 712A, the discharge port 732 provides access to the discharge chamber 714A, and the water intake port 736 provides access to the water intake chamber 722. The size and shape of each of these ports is defined to provide optimum performance.

Gas entering the intake port 734 is conveyed into the impeller casting and trapped between two impeller vanes. As the impeller rotates—eccentrically to the liquid ring and casing—the volume between the vanes increases creating a vacuum. As the cycle progresses toward the discharge port 732, the volume decreases as the liquid creates compression. A small amount of liquid typically discharges with the gas.

Therefore, a small amount of make-up liquid may be provided via water intake port 736. This make-up liquid helps maintain the liquid ring, and also absorbs the heat energy of the compression.

In the design shown, the discharge port 732 is smaller than the intake port 734. Both the intake port 734 and the discharge port 732 are crescent shaped with one blunt end. The blunt end 735 of the intake port 734 is arranged so that a rotating vane of an impeller passes over the blunt end 735 after passing over the rest of the intake port 734. This tends to increase the vacuum that draws gas into the space between the vanes of the impeller. In contrast, the blunt end 733 of the discharge port 732 is arranged so that a rotating vane of an impeller passes over the blunt end 733 before passing over the rest of the discharge port 732. The narrowing of the discharge port 732 tends to increase the pressure between the vanes, thereby forcing the gas from the space between the vanes of the impeller.

Figure 14:
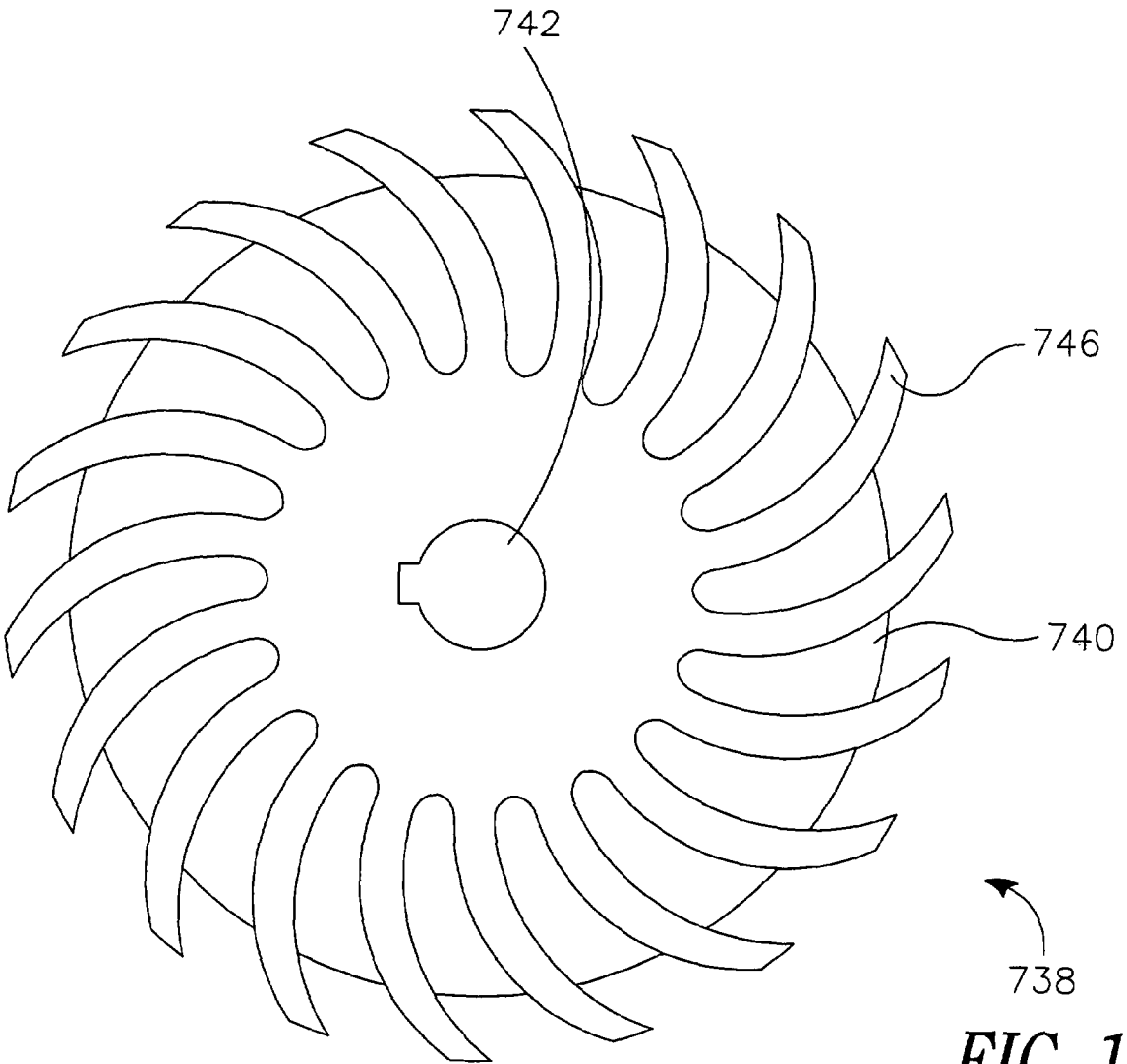
FIG. 14 is a plan view of an impeller of a liquid ring vacuum pump assembly in accordance with an exemplary embodiment of the present invention.

FIG. 14 is an enlarged side view of a preferred impeller 738 for the liquid ring vacuum pump assembly of the present invention. The impeller 738 includes aback plate 740 having a central bore 742 extending therethrough. The back plate 740 is preferably mounted away from the port plate 730 of FIG. 13, with the vanes 746 extending between the back plate 740 and the port plate 730. The central bore 742 of the back plate 740 receives a drive shaft from the motor 16 through the central bore of the port plate 730 and the base plate 710. The vanes 746 of the impeller 738 are preferably curved in shape, as shown. The curved vanes 746 extend outward away from the back plate, and substantially perpendicular to the back plate 740. It has been found that using curved vanes significantly increase the performance of the vacuum pump over a vacuum pump that uses straight vanes.

Figure 16:
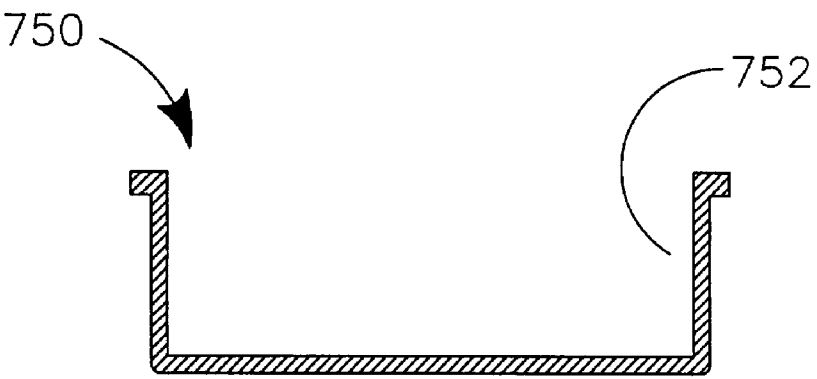
FIG. 16 is a cross-sectional side view of the cover of FIG. 15.
Figure 15:
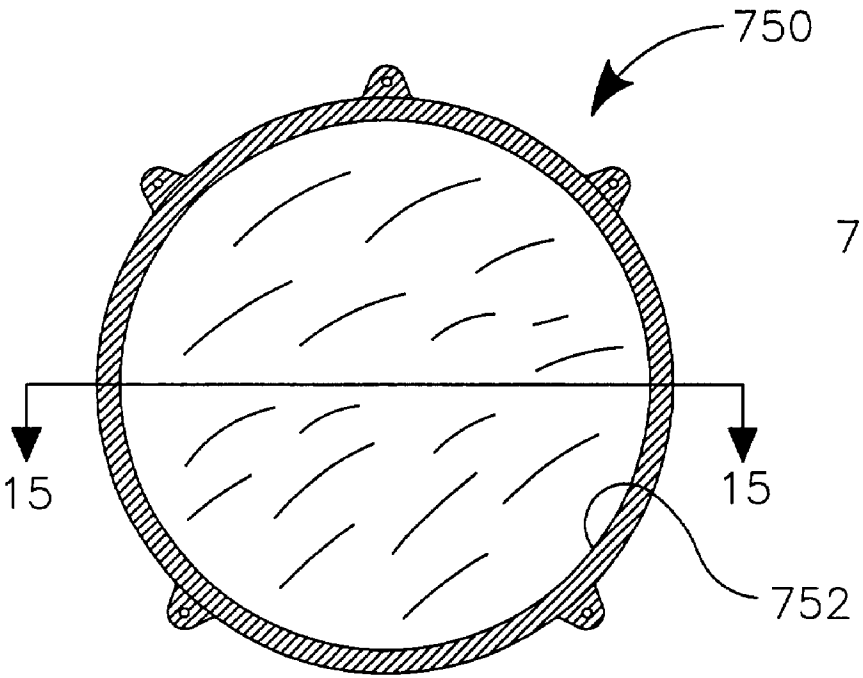
FIG. 15 is a top view of a cover of a liquid ring vacuum pump assembly of in accordance with an exemplary embodiment of the present invention.

FIG. 15 is a top view of a cover 750 that is provided over the impeller 738. FIG. 16 is a cross-sectional side view of the cover of FIG. 15 taken along line 15-15. The cover 750 is bolted to the base plate 710, and is sized to provide a gap between the curved vanes 746 and the inner surface 752 of the cover. At the nearest point between curved vanes 746 and inner surface 752, this gap is preferably between 0.20 millimeters and 2.00 millimeters. This gap is preferably occupied by water provided through the water intake port 736 shown in FIG. 13. The water provides both a seal and lubrication between the curved vanes 746 and the cover 750.

The liquid ring vacuum pump of the present invention provides a high flow rate. Also, and unlike many oil lubricated vacuum pump systems, the liquid ring vacuum pump of the present invention does not provide any oil discharge, which is good for the environment.

To change the capacity of the liquid ring vacuum pump of the present invention, only two parts need to be changed; the impeller 738 and the cover 750. For more capacity, the impeller is replaced with an impeller that has wider vanes 746. To accommodate the wider vanes 746, a deeper cover 750 must also be provided. Conversely, for less capacity, the impeller can be replaced with an impeller with narrower vanes 746. To accommodate the narrower vanes 746, a shallower cover 750 must be provided. Under some circumstances, such as when a large capacity change is desired, it also maybe desirably to change the port plate 730 to increase or decrease the size or shape of the intake and/or discharge ports.

The exhaust of the liquid ring vacuum pump 12 is preferably provided through discharge bore 712 (see FIG. 12). The vacuum pump discharge typically includes both air and water. To recapture the water, the vacuum pump discharge may be provided across a relative cool surface, which tends to condense the water onto the cool surface. The condensed water can then be collected and provided back to the vacuum pump. This closed system allows the liquid ring vacuum pump to operate continuously for long periods of time without having to add significant quantities of water.

It is also contemplated that the vacuum pump discharge may be provided to a muffler. For many prior art pumps, the vacuum pump discharge can produce significant noise. The vacuum pump discharge muffler may include one or more baffles which reduce the noise before the vacuum pump discharge is released to the atmosphere.

It is also contemplated that the exhaust of the vacuum pump may pass through a heat exchanger assembly. In one embodiment, the heat exchanger assembly includes a passageway which is disposed within the separator. In this embodiment, the outer walls of the passageway are in contact with the pumped material which can often be used to cool the exhaust exiting the vacuum pump discharge. Liquid which condenses in the passageway may be collected and channeled back to the liquid ring vacuum pump.

Figure 17:
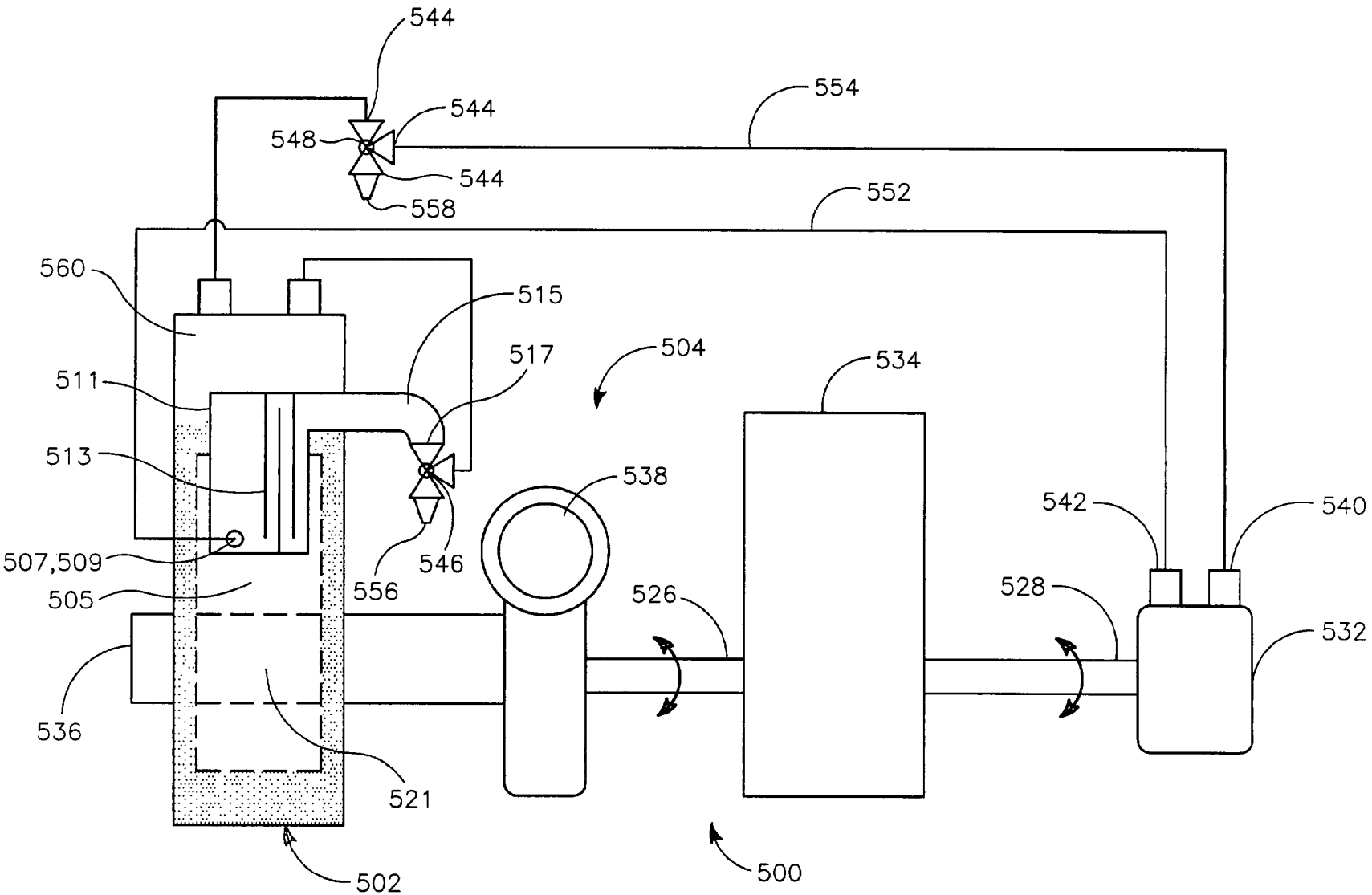
FIG. 17 is a diagrammatic representation of a pump assembly with pressure assisted back flush.

FIG. 17 is a diagrammatic representation of a pump assembly 500 with pressure assisted back flush. Pump assembly 500 includes a motor 534, a primary pump assembly 504, and a vacuum pump 532. Motor 534 includes a first drive shaft end 526 and a second drive shaft end 528. First drive shaft end 526 is coupled to primary pump assembly 504. Second drive shaft end 528 is coupled to vacuum pump 532.

Pump assembly 500 also includes a separator 502. A reservoir 560 of separator 502 is in fluid communication with primary pump assembly 504. Separator 502 includes an intake port 536 and primary pump assembly 504 includes an output port 538. Separator 502 also includes an inner tank 503 which is disposed within reservoir 560. Inner tank 503 defines a passageway 505 extending through reservoir 560. Passageway 505 is preferably fluidly isolated from reservoir 560 and thermally coupled to reservoir 560. Passageway 505 includes an inlet port 507 and an outlet port 509. Outlet port 509 is preferably directly across from inlet port 507. Outlet port 509 of passageway 505 is in fluid communication with a muffler 511. In the embodiment of FIG. 17, muffler 511 includes a plurality of baffles 513 and an elbow 515 terminating with a muffler outlet 517.

Vacuum pump 532 includes an intake 540 and a discharge port 542. Intake 540 of vacuum pump 532 is in fluid communication with a port 544 of a second valve 548 via a second conduit 554. Discharge port 542 of vacuum pump 532 is in fluid communication with a port 544 of a first valve 546 via a first conduit 552, inlet port 507 of passageway 505, outlet port 509 of passageway 505, muffler 511, and muffler outlet 517.

In a preferred embodiment, first valve 546 and second valve 548 are three way valves. First valve 546 and second valve 548 may include various types of valves. Examples of valves that may be suitable include solenoid valves, air piloted valves, and manual valves. In a particularly preferred embodiment, first valve 546 and second valve 548 are coupled together so that they are actuated more or less simultaneously. In this preferred embodiment, first valve 546 and second valve 548 may be coupled together utilizing various methods of coupling. For example, first valve 546 and second valve 548 may be mechanically coupled, electrically coupled, and/or pneumatically coupled.

During a typically pumping operation utilizing pump assembly 500, the inlet of vacuum pump 532 may be coupled to reservoir 560 of separator 502 via second valve 548 and the outlet of vacuum pump 532 may be coupled to first valve vent 556 via first valve 546. During a pumping operation utilizing pump assembly 500, it may sometimes be desirable to back flush pump assembly 500. For example, inlet 536 of pump assembly 500 may be coupled to a proximal end of a hose and a strainer may be coupled to a distal end of the hose. Suction created at the distal end of the hose during a pumping operation may cause the strainer to become clogged. Back flushing may be utilized to un-clog the strainer.

To back flush pump assembly 500, first valve 546 may be switched to place discharge port 542 of vacuum pump 532 in fluid communication with reservoir 560 of separator 502 closing vent 556. In a similar manner, second valve 548 may be switched to place intake 540 in fluid communication with second valve vent 558. In a preferred method of the present invention, first valve 546 and second valve 548 are switched substantially simultaneously. With first valve 546 and second valve 548 switched as described above, vacuum pump 532 may be used to increase the pressure in reservoir 560 sufficiently to back flush pump assembly 500. In a particularly preferred method of the present invention, the pressure in reservoir 560 is increased to about 14 psig. With the primary pump turned off, the effect of gravity on the pumped material may also help back flush the system.

Methods in accordance with the present invention have been envisioned in which various pressure sources may be utilized to pressurize reservior 560. Examples of pressure sources which may be suitable in some applications include an air compressor, the discharge from a venturi system, and the discharge from an oil lubricated vacuum pump. Embodiments of the present invention have been envisioned in which first valve vent 556 includes a filter, and second valve vent 558 includes a filter.

In a preferred embodiment of pump assembly 500, inner tank 503 defines a lumen 521 which allows fluid within reservoir 560 to pass in a straight line from intake port 536 to primary pump assembly 504. In a preferred embodiment, the diameter of lumen 521 is similar to the diameter of an inlet of primary pump assembly 504 or the maximum diameter of the top of the impeller blades.

Figure 18:
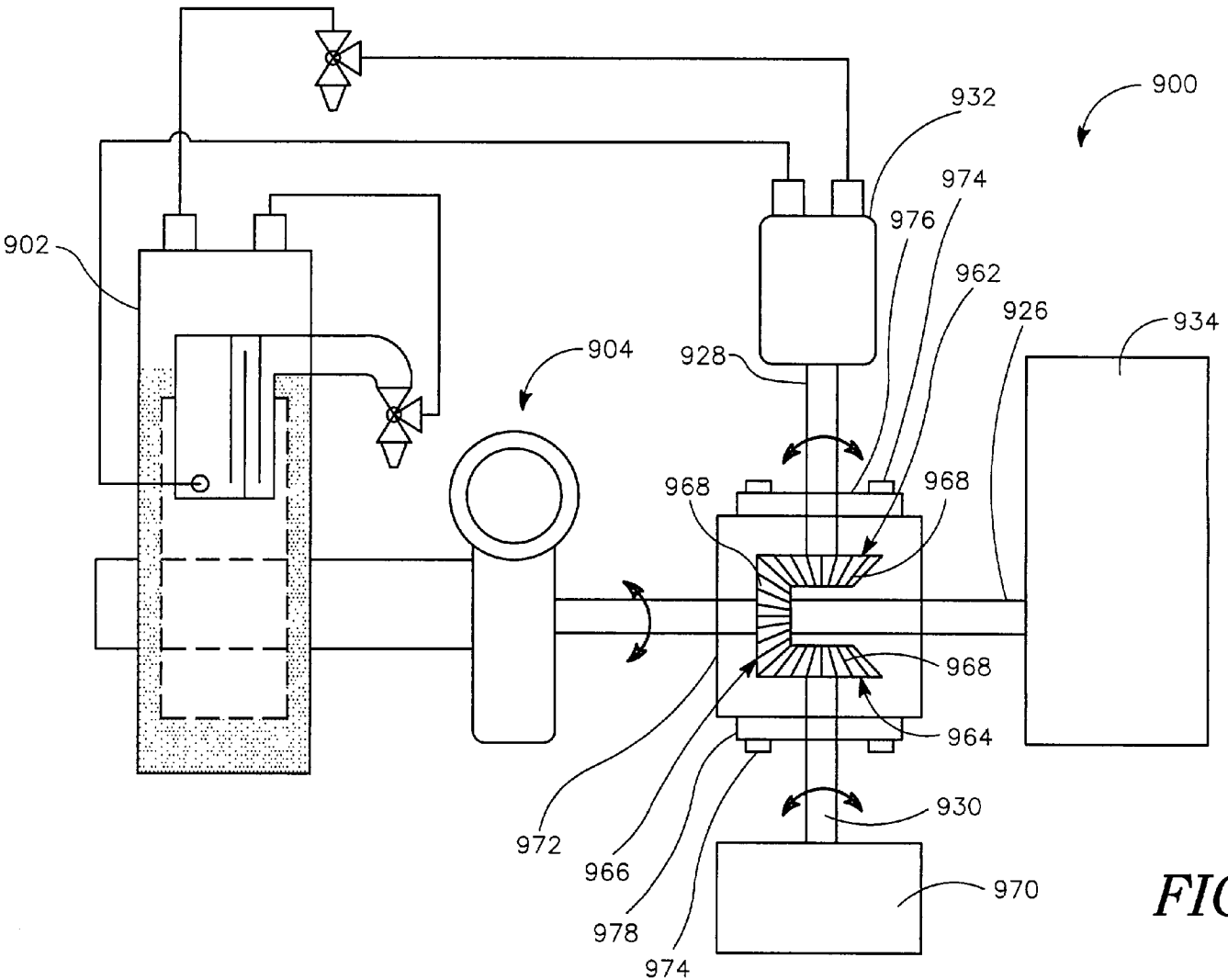
FIG. 18 is a diagrammatic representation of a pump assembly in accordance with an exemplary embodiment of the present invention.

FIG. 18 is a diagrammatic representation of an additional embodiment of a pump assembly 900 with bevel gear drives. Pump assembly 900 includes a separator 902, a primary pump assembly 904, a vacuum pump 932 and a motor 934. Motor 934 includes a first drive shaft end 926. First drive shaft end 926 is coupled to primary pump assembly 904. A bevel gear 966 having a plurality of gear teeth is disposed about first drive shaft end 926. A vacuum pump bevel gear 962 having a plurality of gear teeth 968 is disposed proximate bevel gear 966. Gear teeth 968 of vacuum pump bevel gear 962 are intermeshed with gear teeth 968 of bevel gear 966. Vacuum pump bevel gear 962 is fixed to a vacuum pump drive shaft end 928 which drives vacuum pump 932.

An accessory bevel gear 964 having a plurality of gear teeth 968 may also be disposed proximate bevel gear 966. Gear teeth 968 of accessory bevel gear 964 are intermeshed with gear teeth 968 of bevel gear 966. Accessory bevel gear 964 is fixed to an accessory drive shaft 930 which drives an accessory 970. Accessory 970 may include various pieces of equipment adapted to interface with a rotating shaft. For example, accessory 970 may comprise an electrical generator, another vacuum pump, an air compressor, a hydraulic pump, an air conditioning compressor, and the like.

In the embodiment of FIG. 18, pump assembly 900 includes a bevel gear box 972. A first access door 976 is fixed to bevel gear box 972 with a plurality of bolts 974. As shown in FIG. 18, vacuum pump bevel gear 962 is disposed within bevel gear box 972 and vacuum pump drive shaft 928 extends through first access door 976. First access door 976 may include a bearing disposed about the vacuum pump drive shaft 928, if desired.

A second access door 978 may also be fixed to bevel gear box 972 with a plurality of bolts 974. As shown in FIG. 18, accessory bevel gear 964 is disposed within bevel gear box 972 and accessory drive shaft 930 extends through second access door 978. Second access door 978 may include a bearing disposed about accessory drive shaft 930, if desired. First access door 976 and/or second access door 978 may be selectively replaced with a blank access door when not in use.

Figures 19, 20, 21:
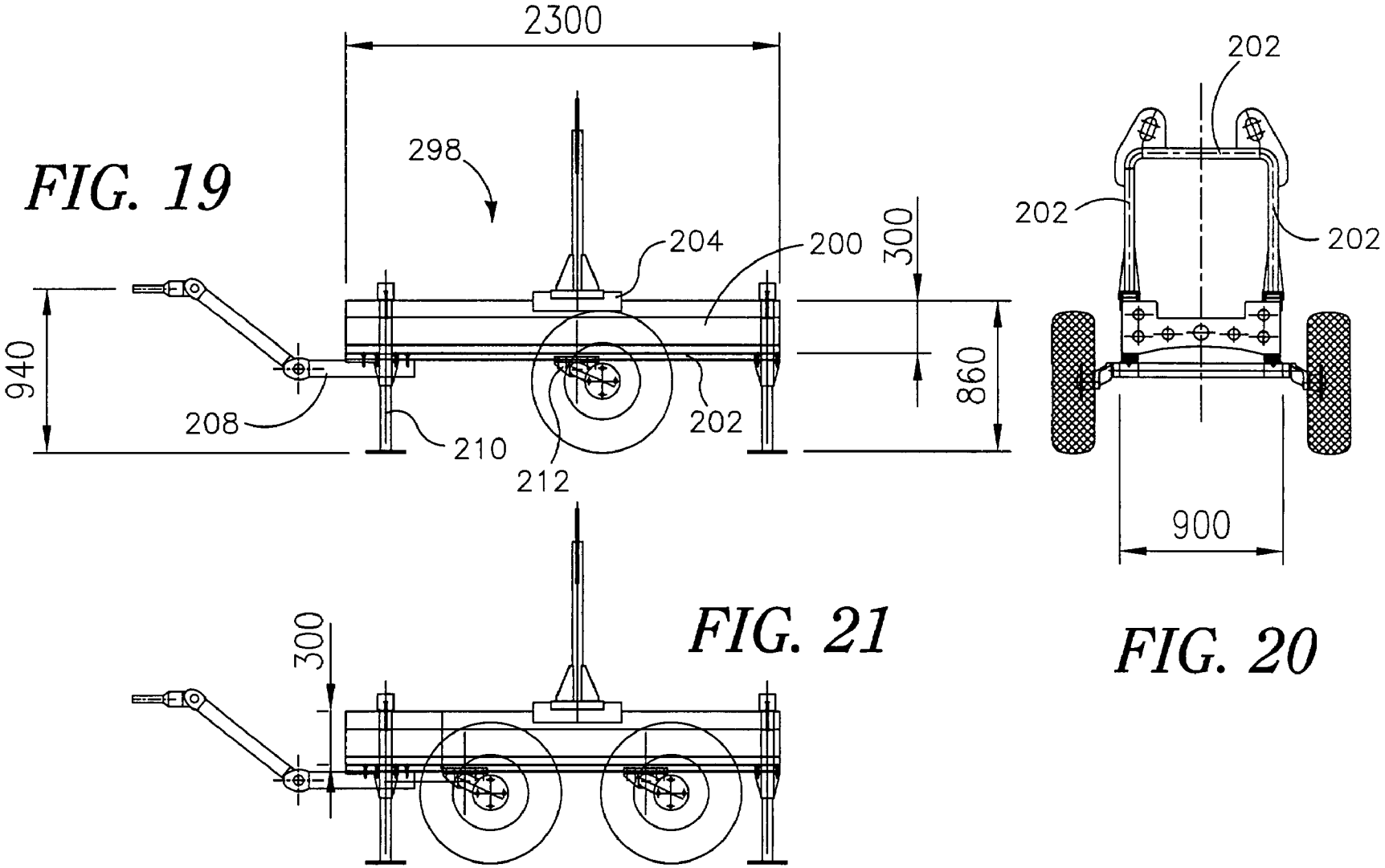
FIG. 19 is a partial cross-sectional side view of a preferred single axle trailer assembly for transporting a pump assembly.
FIG. 20 is a partial cross-sectional bottom view of the single axle trailer assembly of FIG. 19.
FIG. 21 is a partial cross-sectional side view of a preferred two axle trailer assembly for transporting a pump assembly.

Turning now to a trailer assembly that can be used to transport pump assemblies such as those described herein. FIG. 19 shows a partial cross-sectional side view of a preferred single axle trailer assembly, and FIG. 21 is a partial cross-sectional side view of a preferred two axle trailer assembly. The trailer assembly is generally shown at 298, and includes a fuel tank 200 with a lower track bar 202 and an optional upper track bar 204. The lower track bar preferably extends across the front, back, and down the sides of the fuel tank 200, as more clearly shown in FIG. 28. The fuel tank 200 provides most of the support for the trailer assembly 298.

The lower track bar 202 is preferable a hollow elongated support member with a slot extending through the lower side thereof. By placing an insert inside of the hollow support member and bolting a peripheral component such as a trailer tongue 208, a jack stand 210, an axle 212, a fender, etc., to the insert through the longitudinally extending slot, the peripheral components can be easily attached to the fuel tank 200. In addition, because the slot extends along the length of the track bar 202 (either the complete length or a portion thereof), the peripheral component can be selectively attached anywhere along the track bar. This may allow optimum placement of the peripheral components along the length of the trailer. For example, the axle 212 may be placed along the length of the trailer to provide an ideal tongue weight.

The lower track bar 202 may also provide a number of other benefits. For example, the lower track bar 202 may provide additional strength to the fuel tank 200. The lower track bar 202 may also serve as a base when setting the fuel tank 200 on the ground. Finally, the lower track bar 202 may be utilized to fix fuel tank 200 to a truck bed or other mounting surface.

The optional upper track bar 204 operates in a similar manner. In FIG. 21, a lifting bail is attached to the upper track bar 204 for lifting the trailer (and pump assembly when so provided) via a crane or the like. Unlike the lower track bar 202, the slot in the upper track bar 204 extends through the upper side surface thereof.

Many trailers have some or all of the peripheral components pre-welded to the trailer frame. It has been recognized, however, that this tends to increase shipping costs, particularly when the shipping costs are dependent on the overall volume occupied by the trailer assembly. Because the track bar 202 allows all or most of the peripheral components to be easily bolted onto the trailer after shipping, the overall volume and thus the cost of shipping the trailer can be significantly reduced.

Figure 22:
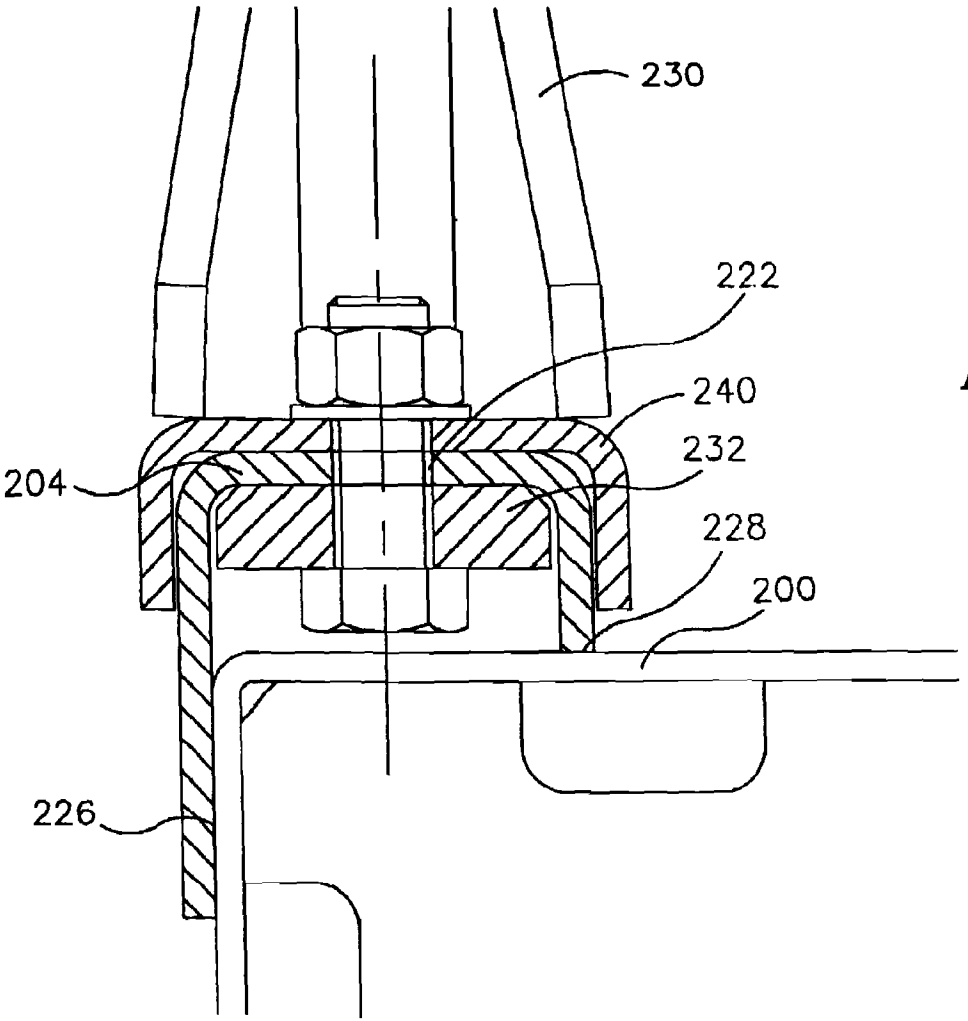
FIG. 22 is a partial cross-sectional side view of an attachment mechanism for attaching the lifting bail to the upper track bar of the trailer assembly of FIG. 19.

FIG. 22 is a partial cross-sectional side view of an attachment mechanism for attaching the lifting bail to the upper track bar 204 of the trailer assembly of FIG. 19. The upper track bar 204 is shown attached to the fuel tank 200 at locations 226 and 228. The upper track bar 204 is shown as a hollow elongated support member with a slot 222 extending through the upper side thereof.

The lifting bail 230 is attached to the upper track bar 204 by first providing insert 232 inside the hollow support member 204. The lifting bail 230 is then bolted to the insert 232 through slot 222, as shown. The lower portion of the lifting bail 230 may have a lower support 240. Lower support 240 extends around the sides of upper track bar 204 to provide added lateral support. Because the slot 222 extends along the length of the track bar 204, the lifting bail can be selectively positioned along the track bar. This may allow the lifting bail to be placed at an optimum balancing location so that the trailer and pump assembly are properly balanced when lifted. Also, the upper trackbox 204 may be constructed similar to the lower trackbox discussed above.

Figure 23:
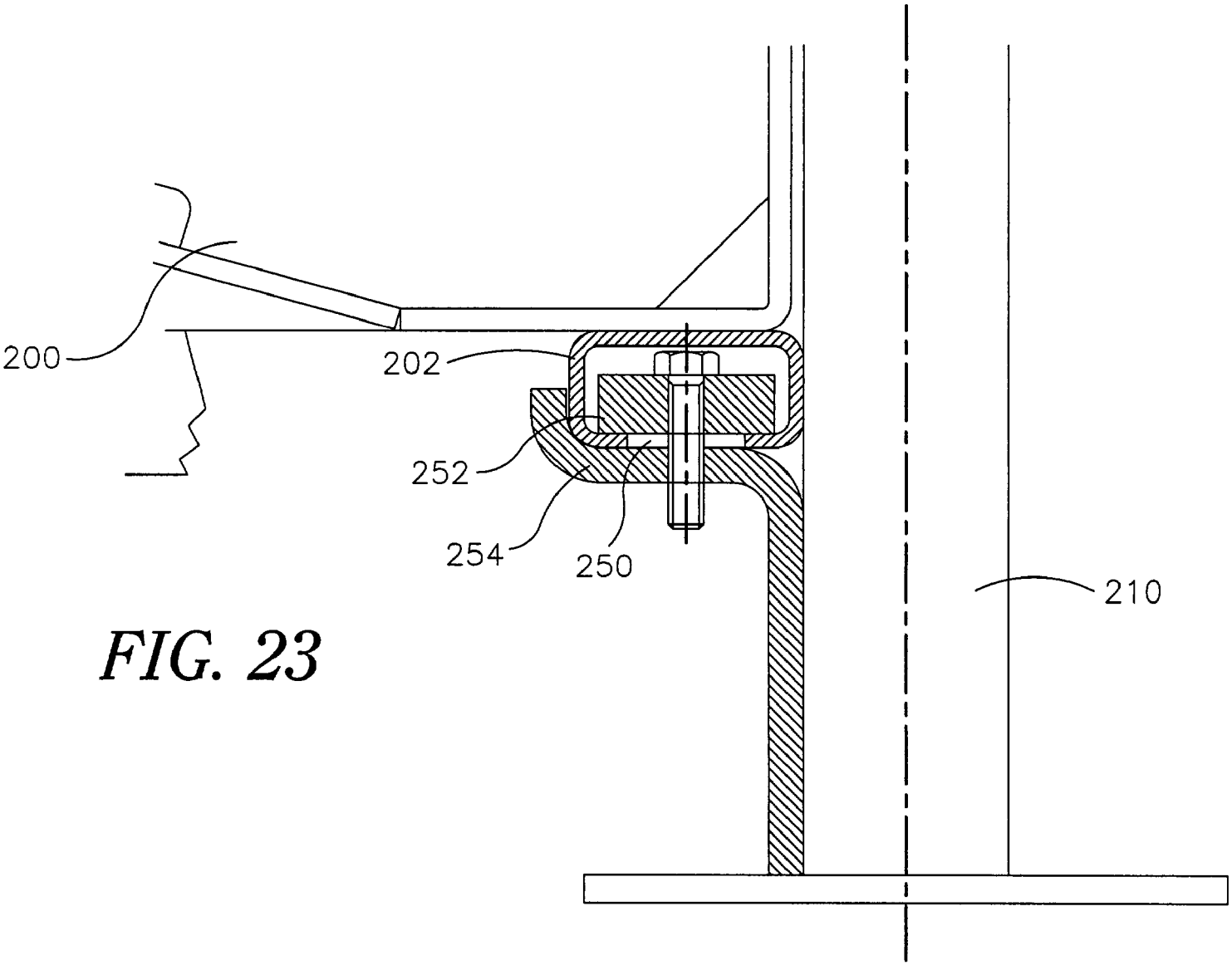
FIG. 23 is a partial cross-sectional side view of an attachment mechanism for attaching a jack stand to the bottom track bar of the trailer assembly of FIG. 19.

FIG. 23 is a partial cross-sectional side view of an attachment mechanism for attaching a jack stand 210 to the bottom track bar 202 of the trailer assembly. The lower track bar 202 is shown as a hollow elongated support member with an elongated slot 250 extending through the lower side thereof. Jack stand 210 is attached to the fuel tank 200 by placing an insert 252 inside the hollow support member 202, and bolting the jack stand support member 254 to the insert 252 through the slot 250. Because the slot extends along the length of the track bar 202, the jack stand 210 can be selectively attached anywhere along the track bar 202. The upper track bar 204 can be extended the full length of the fuel tank 200, and may be used to attach, for example, a debris cover over the top of the pump, a protective cover made from a wire mesh, or a sound attenuating cover.

Figure 24:
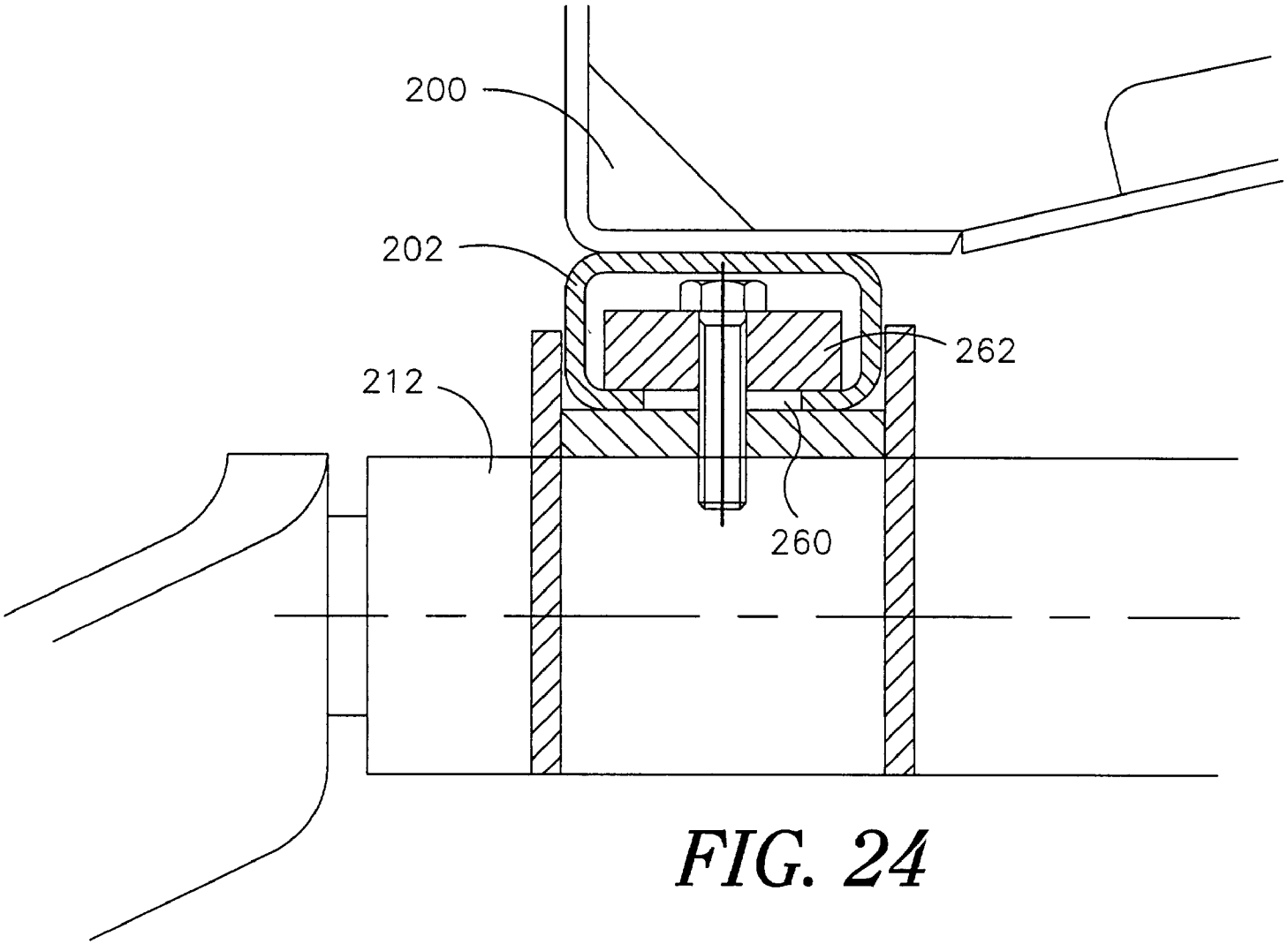
FIG. 24 is a partial cross-sectional side view of an attachment mechanism for attaching the axle assembly to the bottom track bar of the trailer assembly of FIG. 19.

FIG. 24 is a partial cross-sectional side view of an attachment mechanism for attaching the axle assembly 212 to the bottom track bar 202 of the trailer assembly. Like above, the lower track bar 202 is shown as a hollow elongated support member with a slot 260 extending through the lower side thereof. Axle 212 is attached to the fuel tank 200 by placing an insert 262 inside the hollow support member 202, and bolting the axle 212 to the insert 262 through the slot 260. Because the slot extends along the length of the track bar 202, the axle 212 can be selectively attached anywhere along the track bar 202. This may allow the optimum placement of the axle 212 along the length of the trailer. For example, the axle 212 may be placed along the length of the trailer to provide an ideal tongue weight.

Figure 25:
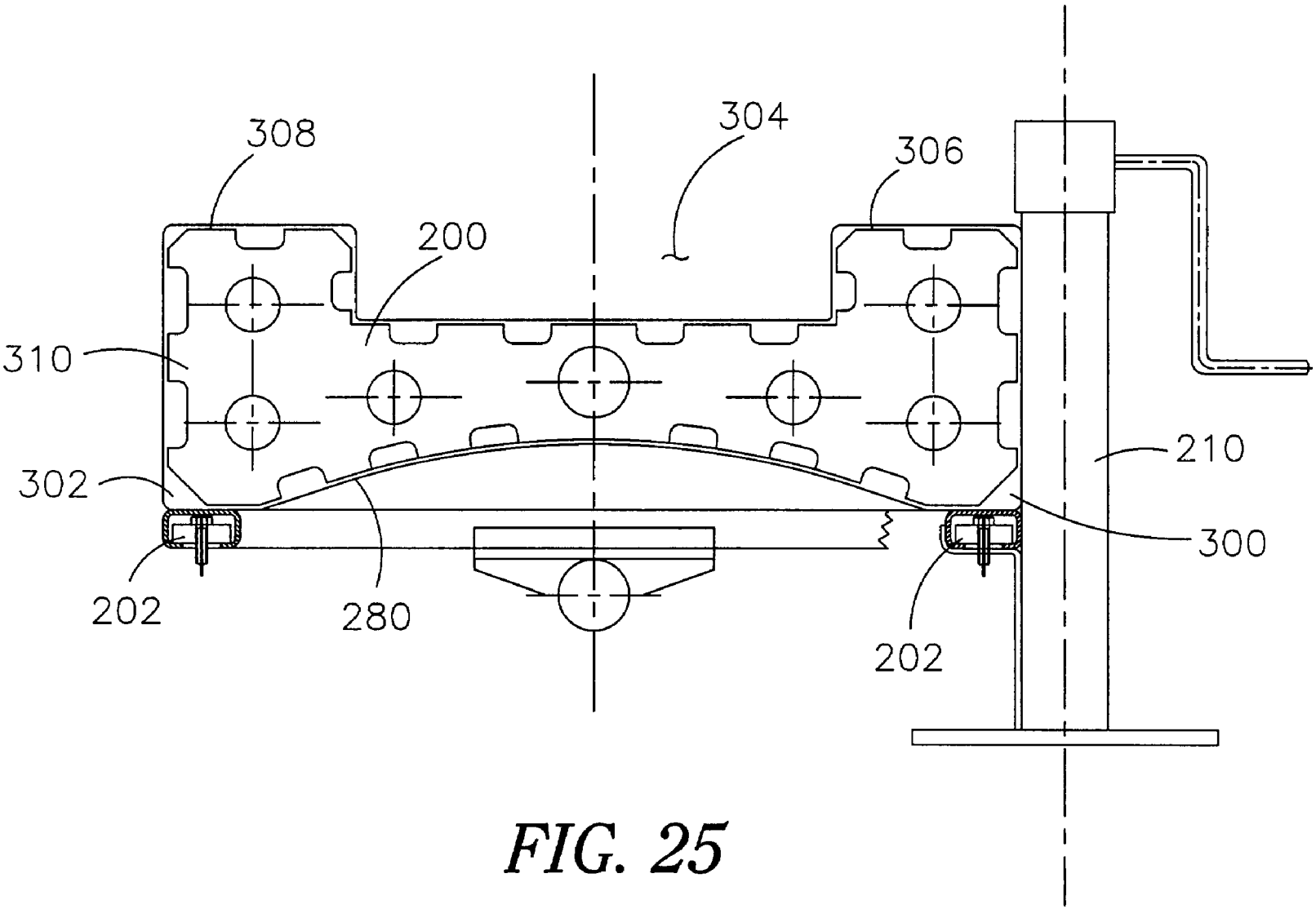
FIG. 25 is a partial cross-sectional rear view of the trailer and fuel tank of FIG. 19.

FIG. 25 is a partial cross-sectional rear view of the trailer and fuel tank 200 of FIG. 19. As indicated above, the fuel tank 200 preferably provides a majority of the support to the trailer assembly. To help increase the rigidity of the fuel tank 200, the upper portion of the fuel tank assumes one-half of an I-beam type configuration including a recessed portion 304 that extends between two elevated portions 306 and 308. This construction is believed to significantly increases the rigidity of the fuel tank 200.

In addition, the bottom surface of the fuel tank 200 is preferably curved upward, as shown. This provides a number of benefits. First, the curved lower surface 280 of the fuel tank 200 helps increase the rigidity and strength of the fuel tank 200. Second, the curved lower surface 280 causes any water, sediment or other contaminates that enters the fuel tank 200 to settle along either side of the fuel tank. Flush ports (not shown) are then provided at the lower side portions 300 and 302 of the fuel tank 200 to help remove the collected water, sediment or contaminates from the fuel tank.

The fuel tank 200 may have a number of baffles, such as baffle 310. These baffles help reduce rapid movement of the fuel within the fuel tank 200. This may help the trailer assembly handle better when moved. The baffles also help provide added rigidity and strength to the fuel tank 200.

It is contemplated that the separator 10, primary pump assembly 12, motor 16 and vacuum pump 14 may be directly mounted to the fuel tank 200, and preferably within the recessed portion 304 of the fuel tank 200. By mounting the primary pump assembly 12 in the recessed portion 304 of the fuel tank, the primary pump assembly 12 can be located closer to the ground, thereby increasing the effective suction performance of the pump.

Figure 26:
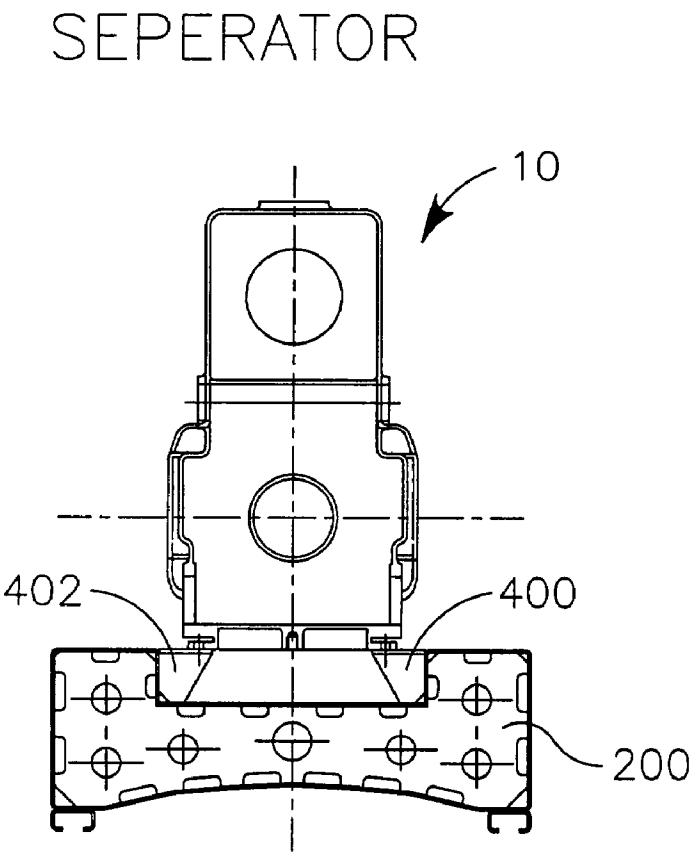
FIG. 26 is a partial cross-sectional rear view of the fuel tank with a separator mounted thereon.

FIG. 26 shows the fuel tank 200 with the separator 10 mounted thereto. The separator is preferably bolted to mounting brackets 400 and 402. Mounting brackets 400 and 402 are preferably welded to the fuel tank 200.

Figure 27:
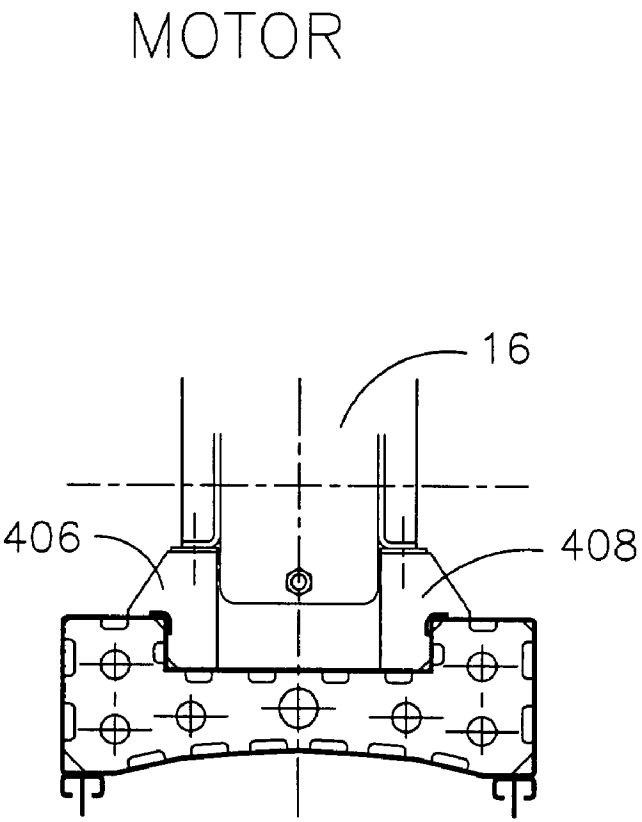
FIG. 27 is a partial cross-sectional rear view of the fuel tank with a motor mounted thereon.

FIG. 27 is a cross-sectional side view of fuel tank 200 with motor 16 mounted there to. Motor 16 is preferably bolted to mounting brackets 406 and 408. Mounting brackets 406 and 408 are also preferably welded to the fuel tank 200. The liquid ring vacuum pump assembly 14 may be similarly attached.

Figure 28:
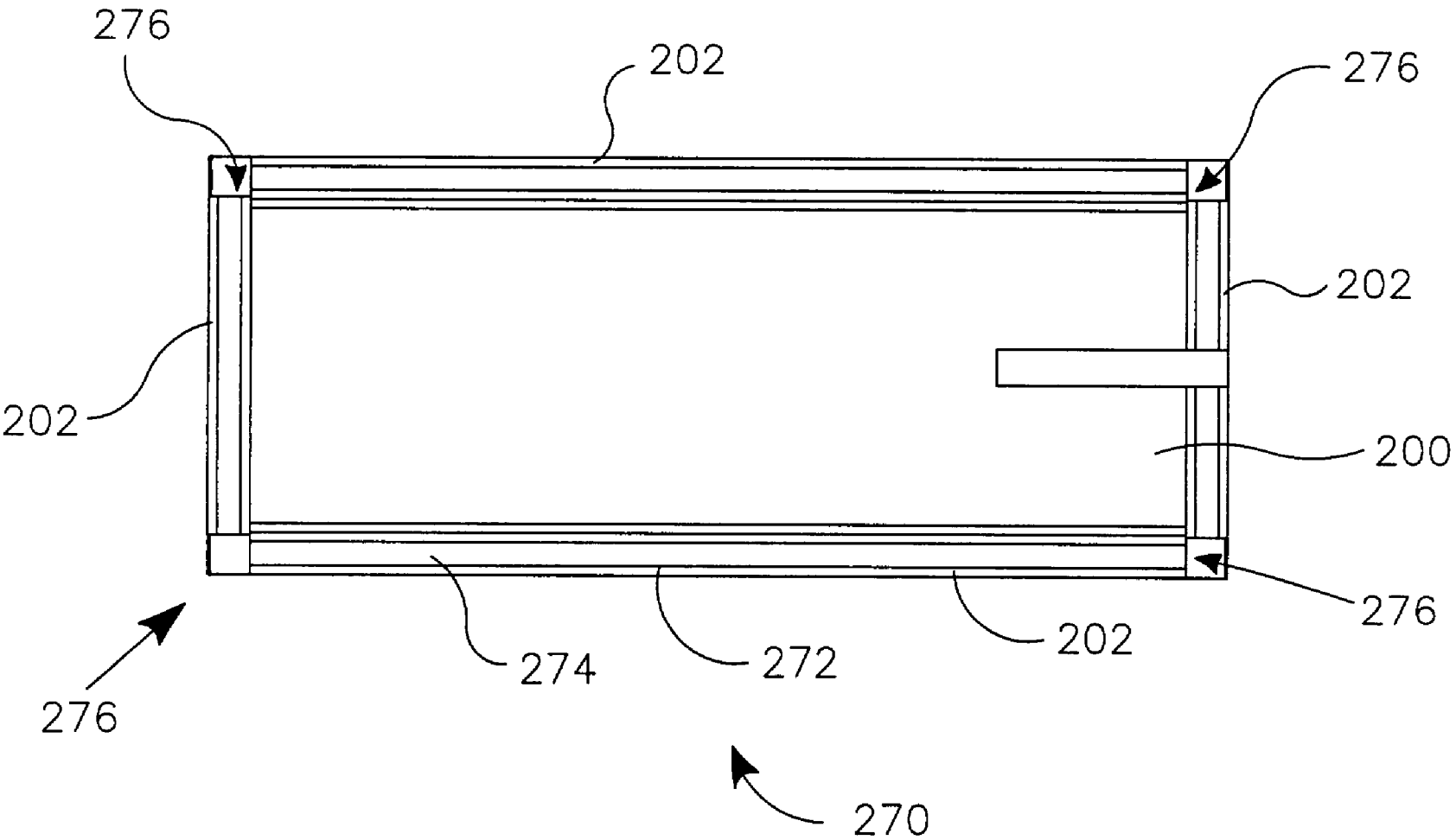
FIG. 28 is a plan view of a trailer in accordance with an exemplary embodiment of the present invention.

FIG. 28 is a plan view of an additional embodiment of a trailer 270 in accordance with the present invention. Trailer 270 includes a fuel tank 200 and a plurality of lower track bars 202. Lower track bars 202 extend across the front and down the sides of fuel tank 200. Each lower track bar 202 includes a slot 272 into a channel 274. Each lower track bar 202 preferably terminates before reaching the end of fuel tank 200. This allows an insert to be inserted into the channel 274 of any lower track bar 202 proximate the corner 276. Trailer 270 also includes a square receiving tube 278 which is fixed to tank 200. Square receiving tube 278 defines a cavity 279 for receiving a trailer tongue assembly.

Figure 29:
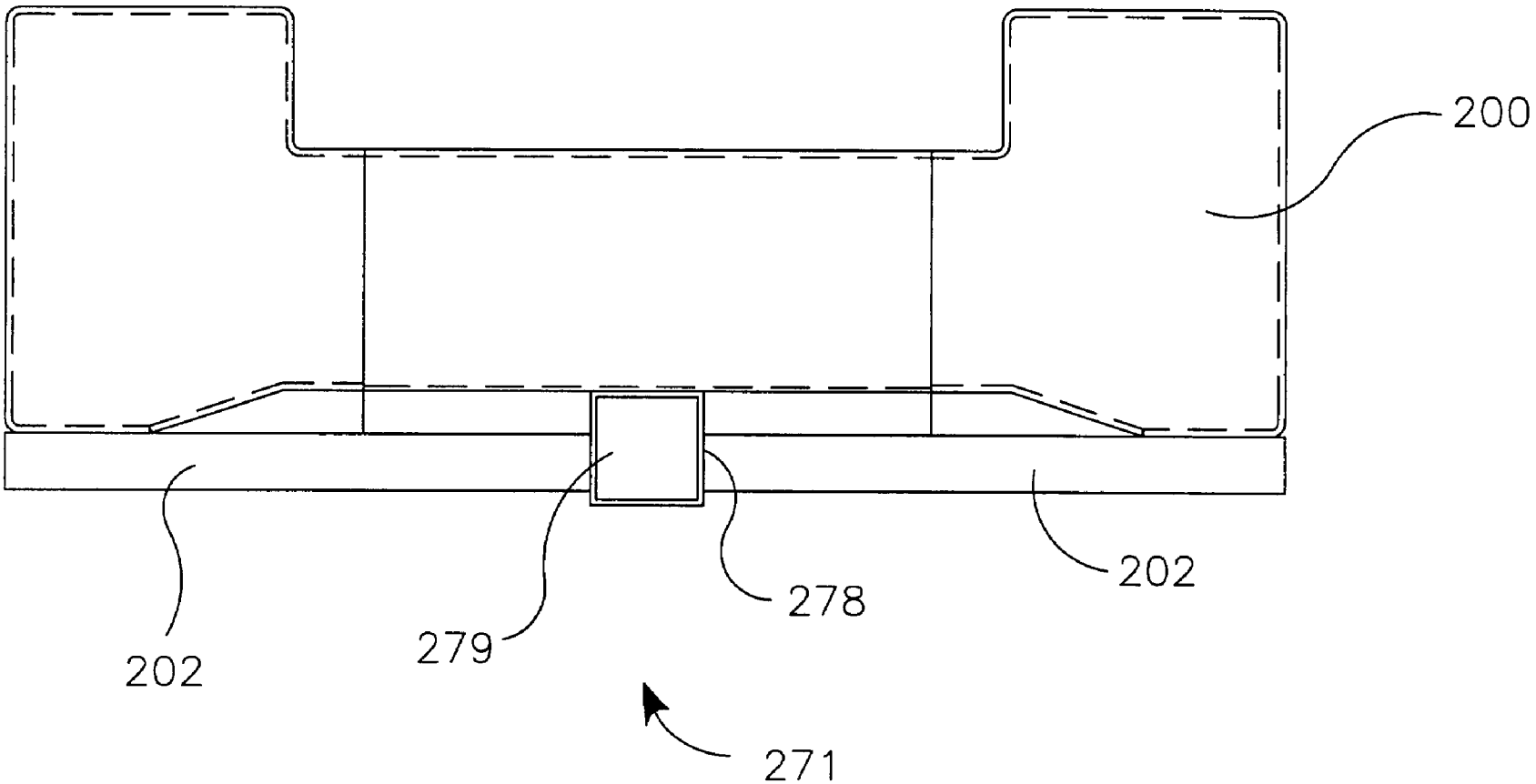
FIG. 29 is a plan view of an assembly in accordance with an additional exemplary embodiment of the present invention.

FIG. 29 is a plan view of an assembly 271 in accordance with the present invention. Assembly 271 includes a fuel tank 200 and a plurality of lower track bars 202. In the embodiment shown, lower track bars 202 extend across the front of the fuel tank 200. Assembly 271 also shows a square receiving tube 278 which is fixed to tank 200. Square receiving tube 278 defines a cavity 279 for receiving a trailer tongue assembly (not shown). In FIG. 29 it may be appreciated that the bottom surface of square receiving tube 278 is generally flush with the bottom surface of lower track bars 202. This may allow the assembly to have a relatively flat base which helps provide stability when the assembly 271 is placed on the ground or on the bed of a truck. Further, the trailer tongue assembly can remain installed in cavity 279 even when the assembly 271 is placed on the ground.

Figure 30:
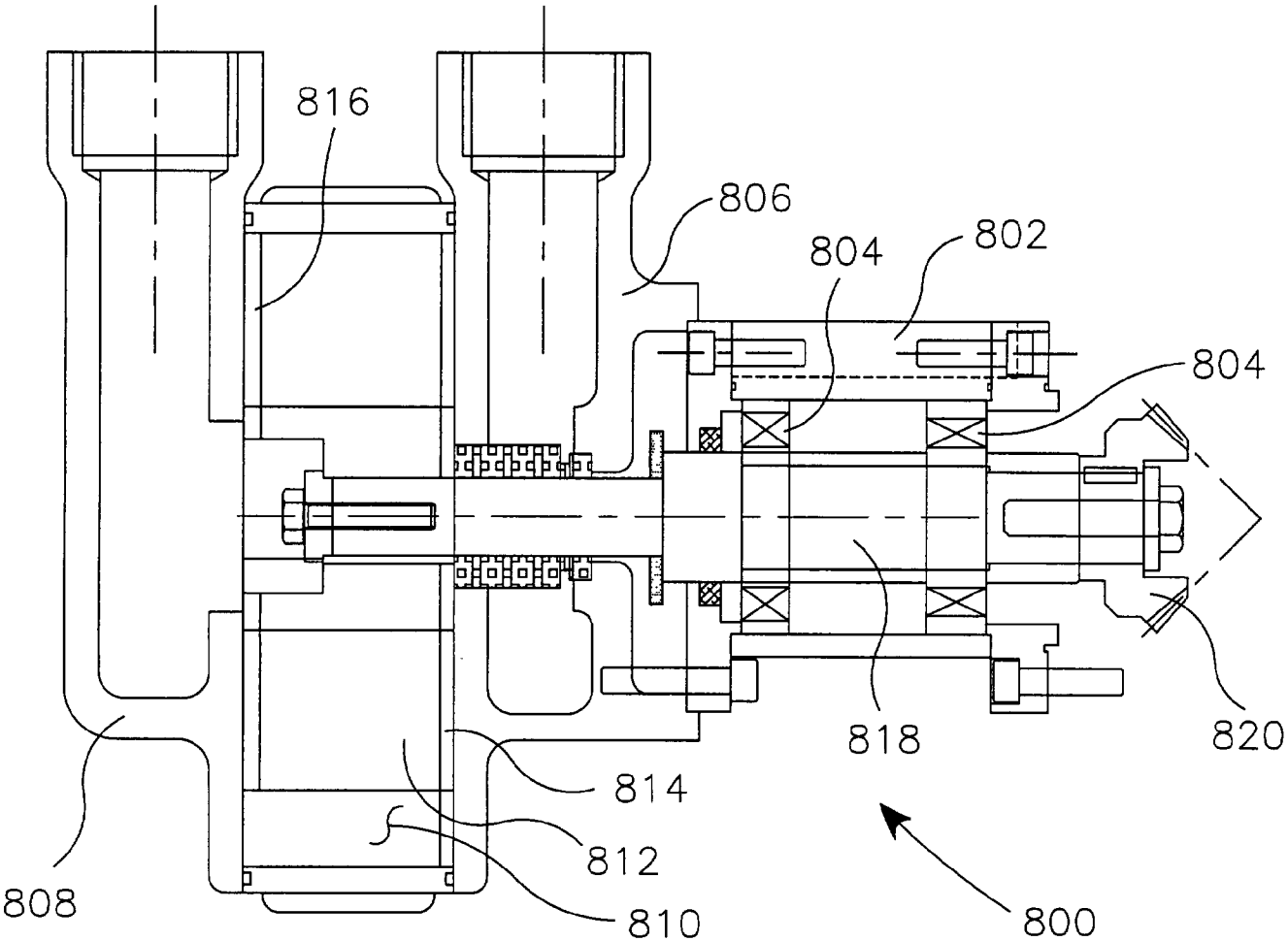
FIG. 30 is a cross-sectional side view of a vacuum pump assembly in accordance with an exemplary embodiment of the present invention.

FIG. 30 is a cross-sectional side view of a vacuum pump assembly 800 in accordance with the present invention. Vacuum pump assembly 800 includes a bearing housing 802 including a plurality of bearings 804. Bearing housing 802 is fixed to a drive side housing 806. Drive side housing 806 is fixed to an outside housing 808. Drive side housing 806 and outside housing 808 define an impeller chamber 810. An impeller 812 is disposed in impeller chamber 810 between a first port plate 814 and a second port plate 816. First port plate 814 is preferably fixed to drive side housing 806 and second port plate 816 is preferably fixed to outside housing 808. Impeller 812 is fixed to a drive shaft 818 proximate it's distal end. Drive shaft 818 extends through drive side housing 806 and bearing housing 802. A bevel gear 820 is fixed to drive shaft 818 proximate it's proximal end.

Figure 32:
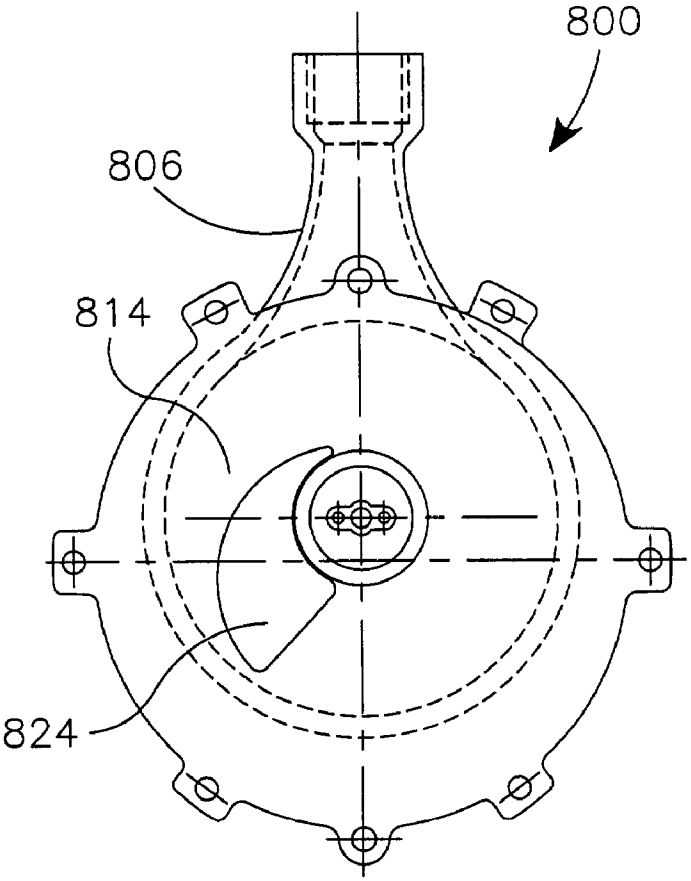
FIG. 32 is a plan view of an assembly in accordance with the present invention including a drive side housing and a port plate.
Figure 31:
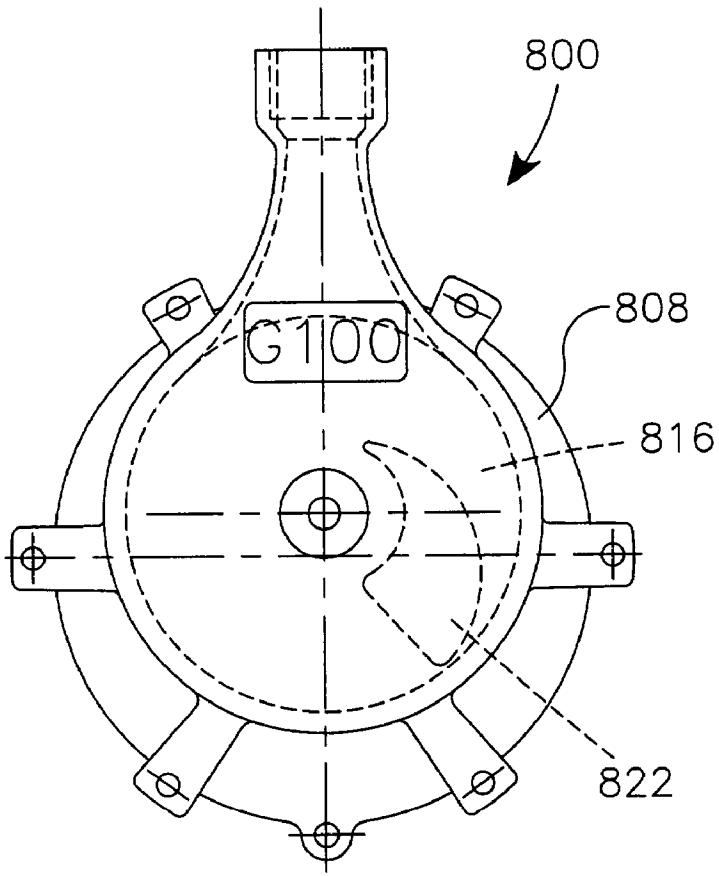
FIG. 31 is a plan view of vacuum pump assembly of FIG. 30.

FIG. 31 is a plan view of vacuum pump assembly 800 of FIG. 30. Outside housing 808 of vacuum pump assembly 800 is visible in FIG. 31. In FIG. 31 it may be appreciated that second port plate 816 defines a second port 822. FIG. 32 is a plan view of an assembly including drive side housing 806 and first port plate 814. In FIG. 32 it may be appreciated that first port plate 814 defines a first port 824.

Figure 33:
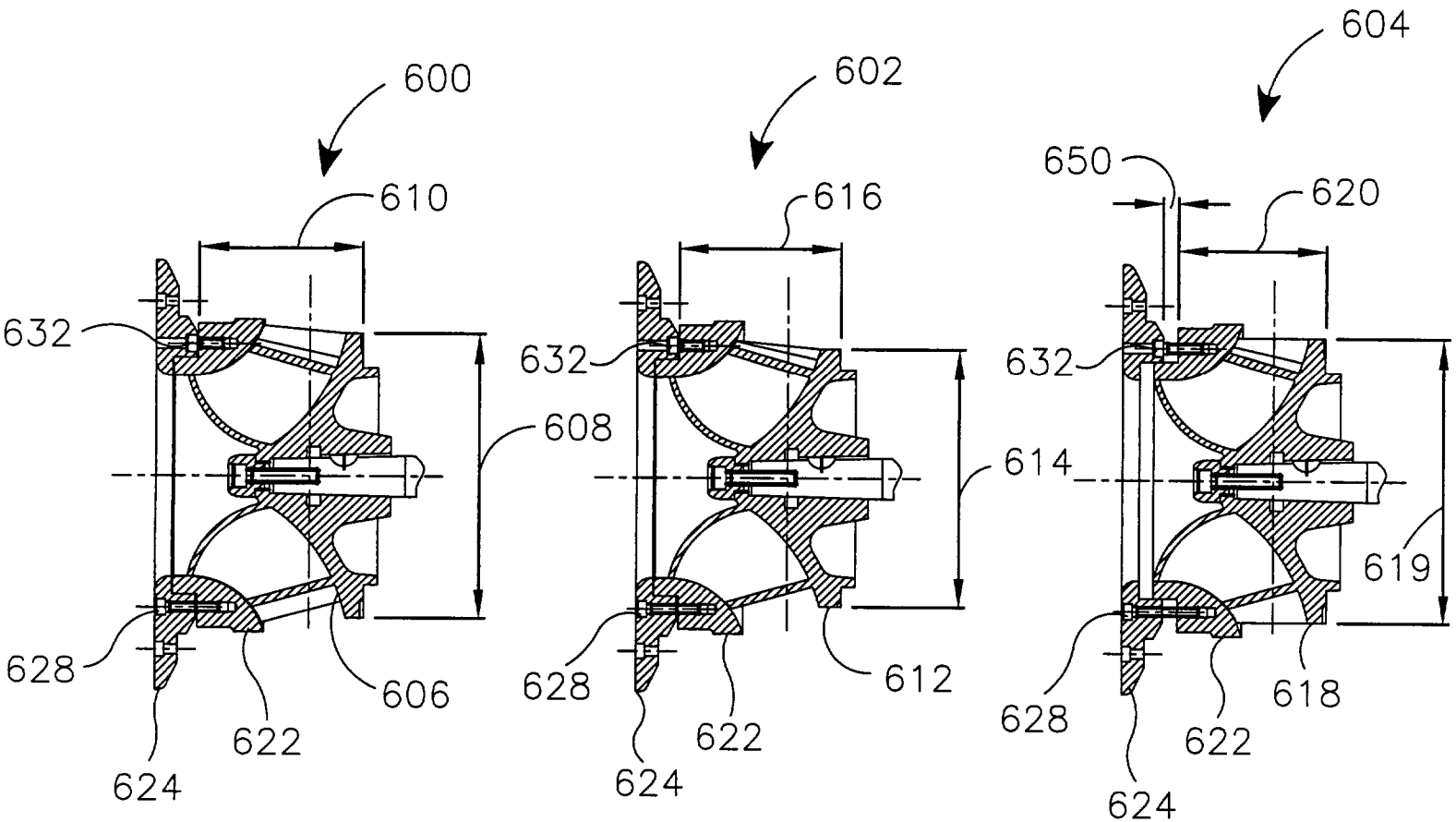
FIG. 33 is a cross sectional view of a first assembly, a second assembly, and a third assembly in accordance with the present invention.

FIG. 33 is a cross-sectional view of a first assembly 600, a second assembly 602, and a third assembly 604. Assembly 600 includes an impeller 606 having a maximum diameter 608 and a maximum height dimension 610. This configuration provides maximum head, maximum solids and maximum flow. This configuration may be used when maximum performance in all areas is desired. Assembly 602 includes an impeller 612 having a minimum diameter 614 and a maximum height dimension 616. This configuration provides lower head, maximum solids and lower flow, and may require less power than assembly 600. This configuration may be used when maximum solid passage is more important than head or flow. Finally, assembly 604 includes an impeller 618 having a maximum diameter 619 and minimum height dimension 620. This configuration provides maximum head, smaller solids and lower flow, and may require less power than assembly 600. This configuration may be used when maximum head is more important that solid passage. Other configurations are also contemplated.

This diagram illustrates that the same volute and front wear plate can be used in conjunction with many different impeller configurations. This may minimize the time and cost of changing the impeller, and thus the pump characteristics.

As indicated above, the position of front plate 622 may be adjusted either toward or away from the impeller. In this embodiment, the front wear plate 622 is made adjustable more than is necessary to accommodate wear of the impeller. Rather, the front wear place 622 is made to be sufficiently adjustable to accommodate various different impellers. In a preferred embodiment, the width of gap 650 may vary from about 0 inches to about 1.0 inch or more, and more preferably between about 0 inches to about 0.5 inches. This range is typically sufficient to accommodate a sufficient variety of impellers to achieve most pumping needs.

Another feature of the present invention is that the back wear plate (see FIG. 3) is fixed to the volute. This may allow a pump accommodate impellers that have differing diameters. One reason for this is that the back wear plate may allow the impeller to extend laterally beyond the back plate and into the volute, thereby providing added flexibility in selecting impellers.

Having thus described the preferred embodiments of the present invention, those of skill in the art will readily appreciate that the teachings found herein may be applied to yet other embodiments within the scope of the claims hereto attached.

What is claimed is:

1. A trailer comprising:

a trailer body;

a track bar secured relative to the trailer body;

the track bar having a wall that defines an elongated channel, and further having an elongated slot extending through the wall of the track bar and into the channel, the wall having an inner surface defining the elongated channel and an outer surface;

an accessory; and mounting means including an insert for insertion into the channel of the track bar, a support member attached to or being part of the accessory, and a fastener for attaching the support member to the insert through the slot of the track bar such that the support member engages the outer surface of the track bar and the insert engages the inner surface of the track bar to provide a clamping action on the wall of the track bar.

2. The trailer of claim 1, wherein the accessory is an axle.

3. The trailer of claim 1, wherein the trailer body defines a chamber.

4. The trailer of claim 1, wherein the trailer body comprises a fuel tank.

5. The trailer of claim 1, wherein the mounting means is configured such that the support member provides a clamping force on the outer surface of the track bar wall and the insert provides a clamping force on the inner surface of the track bar wall.

6. A trailer comprising:

a trailer body;

a track bar having a wall that defines an elongated channel, and further having an elongated slot extending through the wall of the track bar and into the channel, the wall having an inner surface defining the elongated channel and an outer surface;

an accessory;

securing means for securing the accessory to the trailer body, said securing means including an insert for insertion into the channel of the track bar, a support member attached to or being part of the accessory, and a fastener for attaching the support member to the insert through the slot of the track bar such that the support member engages the outer surface of the track bar and the insert engages the inner surface of the track bar to provide a clamping action on the wall of the track bar, said securing means adapted to allow the accessory to be selectively secured to the trailer body at any position along a predefined range of positions.

7. A trailer according to claim 6 wherein the accessory is an axle.

8. A trailer according to claim 6 wherein the accessory is a trailer tongue.

9. A trailer according to claim 6 wherein the accessory is a jack stand.

10. A trailer according to claim 6 wherein the accessory is a fender.

11. A trailer according to claim 6 wherein the accessory is a lifting bail.

12. A trailer according to claim 6 wherein the trailer body includes a tank.

13. The trailer of claim 6, wherein the fastener is configured such that tightening the fastener exerts a clamping force in a first direction on the outer surface of the track bar and in a second, opposite direction on the inner surface of the track bar.

14. A method for securing an accessory to a trailer, the method comprising the steps of:

providing a trailer that includes an elongated slot defined in a wall, the wall having a back side surface and a front side surface;

positioning the accessory adjacent to the elongated slot at a desired location along the elongated slot, the accessory being part of, secured to, or capable of being secured to, a support member;

positioning an insert adjacent the back side surface of the wall adjacent the slot;

positioning the support member adjacent to the front side surface of the wall adjacent the insert; and fastening the support member to the insert through the slot such that the support member engages the front side surface of the wall and the insert engages the back side surface of the wall to provide a clamping action on the wall.

15. A method according to claim 14 wherein the elongated slot is provided in a track bar, wherein the track bar includes the wall, which defines an elongated channel and the elongated slot extend through the wall of the track bar and into the channel.

16. A method according to claim 15 wherein the insert positioning step includes positioning the insert into the elongated channel of the track bar.

17. The method of claim 14, wherein the step of fastening includes exerting opposing forces on the front and back side surfaces of the wall.

18. A trailer comprising:

an elongated trailer body;

an elongated track bar secured relative to the elongated trailer body, the elongated track bar having a length that extends lengthwise along at least part of the elongated trailer body;

the elongated track bar further having a wall that defines an elongated channel that extends lengthwise along the elongated track bar, and further having an elongated slot extending through the wall of the track bar and into the channel, the wall having an inner surface defining the elongated channel and an outer surface;

an accessory; and mounting means for mounting the accessory to the trailer at any desired location along the at least part of the elongated trailer body that includes the elongated track bar, said mounting means including an insert for insertion into the channel of the track bar, a support member attached to or being part of the accessory, and a fastener for attaching the support member to the insert through the slot of the track bar such that the support member engages the outer surface of the track bar and the insert engages the inner surface of the track bar to provide a clamping action on the wall of the track bar.

19. The trailer of claim 18, wherein the fastener is configured such that when tightened, it exerts opposing forces on the support member and insert thereby clamping the wall of the track bar between the support member and insert.

* * * * *